US011344165B2

(12) United States Patent
Osborne, Jr.

(10) Patent No.: US 11,344,165 B2
(45) **Date of Patent: *May 31, 2022**

(54) DISPENSER FOR ROLLED SHEET MATERIALS WITH CUTTING SYSTEM

(71) Applicant: Kimberly-Clark Worldwide, Inc., Neenah, WI (US)

(72) Inventor: Charles Agnew Osborne, Jr., Cumming, GA (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 1144 days.

This patent is subject to a terminal disclaimer.

(21) Appl. No.: 15/185,937

(22) Filed: Jun. 17, 2016

(65) Prior Publication Data

US 2016/0353945 A1 Dec. 8, 2016

Related U.S. Application Data

(63) Continuation-in-part of application No. 15/173,970, filed on Jun. 6, 2016, now Pat. No. 10,441,117.
(Continued)

(51) Int. Cl.
*A47K 10/36* (2006.01)
*B65H 20/02* (2006.01)
(Continued)

(52) U.S. Cl.
CPC ..... *A47K 10/3618* (2013.01); *A47K 10/3612* (2013.01); *B65H 20/02* (2013.01);
(Continued)

(58) Field of Classification Search
CPC ..... A47K 10/3612; A47K 10/3618; A47K 10/3606; A47K 10/3625; A47K 10/3643;
(Continued)

(56) References Cited

U.S. PATENT DOCUMENTS 2,738,934 A 3/1956 Dobkin
3,317,150 A * 5/1967 Summersby ..... A47K 10/36 226/138
(Continued)

FOREIGN PATENT DOCUMENTS

FR 2583729 A1 12/1986

OTHER PUBLICATIONS

International Search Report for PCT/US2016/038135, dated Sep. 15, 2016.
(Continued)

*Primary Examiner* — Clark F Dexter

(57) ABSTRACT

A dispenser for dispensing a flexible, rolled sheet material can include a housing and a supply of the sheet material supported within the housing for feeding the sheet material along a path defined through the housing. A feed roller can be rotatably mounted within the housing and have a body that engages the sheet material to pull the sheet material from the supply to dispense a selected amount of the sheet material therefrom. The dispenser also can include pressing rollers positioned adjacent the feed roller and biased to engage the sheet material between the pressing rollers and the feed roller, and a cutting mechanism arranged along the body of the feed roller that can have a cutting blade operatively connected to the body of the feed roller and actuated with rotation thereof to at least partially cut or perforate a selected portion of the sheet material.

10 Claims, 27 Drawing Sheets

Related U.S. Application Data

(60) Provisional application No. 62/315,318, filed on Mar. 30, 2016, provisional application No. 62/299,256, filed on Feb. 24, 2016, provisional application No. 62/181,457, filed on Jun. 18, 2015, provisional application No. 62/230,404, filed on Jun. 4, 2015.

(51) Int. Cl.
*B65H 35/00* (2006.01)
*B65H 35/06* (2006.01)
*B65H 35/08* (2006.01)

(52) U.S. Cl.
CPC ..... *B65H 35/006* (2013.01); *B65H 35/08* (2013.01); *B65H 35/06* (2013.01); *B65H 2301/41306* (2013.01); *B65H 2301/41346* (2013.01); *B65H 2301/5154* (2013.01); *B65H 2301/515323* (2013.01); *B65H 2403/512* (2013.01); *B65H 2404/143* (2013.01); *Y10T 225/205* (2015.04); *Y10T 225/21* (2015.04)

(58) Field of Classification Search
CPC ..... A47K 2010/365; A47K 2010/3668; B65H 35/006; B65H 2301/41306; B65H 2301/41346; B65H 2301/515323; B65H 2301/5154; B65H 2403/512; B65H 2404/143; Y10T 83/896; Y10T 225/205; Y10T 225/206; Y10T 225/21
USPC ..... 83/649; 225/10, 11, 15
See application file for complete search history.

(56) References Cited

U.S. PATENT DOCUMENTS 3,892,368 A * 7/1975 Ricards ..... A47K 10/40 242/564
3,893,636 A 7/1975 Wise et al.
4,003,525 A * 1/1977 Podvin et al. ..... B65H 49/26 242/420.6
4,071,200 A 1/1978 Stone
4,192,442 A 3/1980 Bastian et al.
4,738,176 A 4/1988 Cassia
4,790,490 A 12/1988 Chakravorty
4,846,035 A 7/1989 Granger
5,452,832 A 9/1995 Niada
5,672,206 A 9/1997 Gorman
6,079,305 A 6/2000 Bloch et al.
6,098,917 A 8/2000 Cruz
6,196,102 B1 3/2001 Granger
6,199,792 B1 3/2001 Mivelaz
6,314,850 B1 11/2001 Morand
6,378,725 B1 4/2002 Granger
6,408,727 B1 6/2002 Harris et al.
6,553,879 B2 4/2003 Morand
6,691,945 B2 2/2004 Slezak
6,820,785 B2 11/2004 Kapiloff
6,826,985 B2 12/2004 Broehl
6,834,825 B2 12/2004 Pollastrelli et al.
6,892,620 B2 5/2005 Kapiloff
6,903,654 B2 6/2005 Hansen et al.
6,977,588 B2 12/2005 Schotz et al.
7,213,782 B2 5/2007 Osborne et al.
7,296,765 B2 11/2007 Rodrian
7,370,824 B1 5/2008 Osborne
7,946,522 B2 5/2011 Lewis et al.
7,987,756 B2 8/2011 Lewis et al.
8,082,827 B2 12/2011 Friesen et al.
8,167,228 B2 5/2012 Kobayashi et al.
8,297,160 B2 10/2012 Friesen et al.
8,353,475 B2 1/2013 Kobayashi et al.
8,382,026 B2 2/2013 Keily et al.
8,402,872 B2 3/2013 Friesen et al.
8,528,851 B2 9/2013 Friesen et al.
8,555,761 B2 10/2013 Keily et al.
8,651,003 B1 2/2014 Vercellone
8,800,415 B2 8/2014 Osborne
8,919,233 B2 12/2014 Lewis et al.
9,010,602 B2 4/2015 Budz et al.
9,032,850 B2 5/2015 Chiba et al.
9,701,508 B2 7/2017 Diamond
9,756,992 B2 9/2017 Osborne
9,907,441 B2 3/2018 Osborne et al.
2001/0045149 A1 11/2001 Granger
2005/0051008 A1 3/2005 Granger
2005/0145745 A1 7/2005 Lewis et al.
2005/0167541 A1 8/2005 Osborne
2006/0037449 A1 2/2006 Lavallee
2007/0079684 A1 4/2007 Friesen et al.
2007/0176041 A1 8/2007 Friesen et al.
2007/0215743 A1* 9/2007 Granger ..... A47K 10/3637 242/558
2009/0140001 A1 6/2009 Lewis et al.
2009/0256022 A1 10/2009 Maurer
2010/0102101 A1* 4/2010 Keily et al. ..... B26D 1/425 225/10
2010/0243696 A1 9/2010 Friesen et al.
2010/0319508 A1 12/2010 Hagleitner
2011/0068129 A1 3/2011 Maurer
2011/0133019 A1 6/2011 Keily et al.
2011/0233318 A1 9/2011 Anderson
2012/0085857 A1 4/2012 Vienneau et al.
2012/0167739 A1 7/2012 Lewis et al.
2012/0182366 A1 7/2012 Kobayashi et al.
2012/0312853 A1 12/2012 Osborne et al.
2013/0320130 A1 12/2013 Osborne
2014/0054410 A1 2/2014 Achton
2014/0263812 A1 9/2014 Osborne
2014/0312158 A1 10/2014 Hluschenko et al.
2015/0297043 A1 10/2015 Osborne et al.
2016/0353946 A1* 12/2016 Osborne, Jr. ..... A47K 10/3643
2016/0353947 A1* 12/2016 Osborne, Jr. ..... A47K 10/3643
2017/0188760 A1 7/2017 Henson et al.
2017/0367547 A1 12/2017 Osborne
2017/0369262 A1 12/2017 Green
2018/0170703 A1* 6/2018 Osborne, Jr. ..... B26D 1/16
2018/0263433 A1* 9/2018 Osborne, Jr. ..... A47K 10/3612

OTHER PUBLICATIONS

Written Opinion for PCT/US2016/038135, dated Sep. 15, 2016.
Extended European Search Report of European Application No. 16812545.8 dated Dec. 11, 2018.
Tifco Spline, Inc., "Advantages of Involute Splines as Compared to Straight Sided Splines", Gear Technology, May/Jun. 1985 Issue, pp. 14-16, 3 pages.

* cited by examiner

DISPENSER FOR ROLLED SHEET MATERIALS WITH CUTTING SYSTEM

CROSS REFERENCE TO RELATED APPLICATIONS

The present patent application is a formalization of previously filed, co-pending U.S. Provisional Patent Application Ser. No. 62/181,457, filed Jun. 18, 2015, U.S. provisional Patent Application Ser. No. 62/299,256, filed Feb. 24, 2016, and U.S. Provisional Patent Application Ser. No. 62/315,318, filed Mar. 30, 2016 by the inventor named in the present application. This patent application is also a continuation-in-part of previously filed co-pending U.S. patent application Ser. No. 15/173,970, filed Jun. 6, 2016, which is a formalization of U.S. Provisional Application No. 62/230,404, filed Jun. 4, 2015, by the inventor named in the present patent application. This patent application claims the benefit of the filing date of these cited Provisional patent applications according to the statutes and rules governing provisional patent applications, particularly 35 U.S.C. §119(e), 35 U.S.C. §120 and 37 C.F.R. §1.78(a)-(d). The specification and drawings of the Provisional patent applications referenced above are specifically incorporated herein by reference as if set forth in their entireties.

TECHNICAL FIELD

This disclosure generally relates to dispensers and, more particularly, to electronic dispensers for flexible sheet material such as paper products.

BACKGROUND

A number of different types of dispensing devices for controlling quantities of paper products dispensed such as for restroom and other environments have been developed in recent years. Some such dispensers have included mechanical paper feeding mechanisms, actuated by the user physically touching the dispenser equipment to deliver a fixed length of paper. This bodily contact can, however, raise concerns over hygiene when such dispensers are located in public restroom facilities. More recently, the use of electronic dispensers has become more prevalent especially in public restroom facilities. Similar to manually operated dispensers, electronic dispensers dispense a measured length of sheet material, but their operation generally is initiated by a sensor detecting the presence of a user. Thus, in such "hands free" operations, the user does not have to manually activate or otherwise contact the dispenser in order to initiate a dispense cycle. While electronic dispensers are generally more hygienic and can enable enhanced control of the amount of paper fed, resulting in paper savings, such dispensers can be subject to other problems. For example, conventional electronic dispensers can generally include motors, gears and/or other drive systems that can be expensive and require closer tolerances to manufacture. In addition, such dispensers accumulate static electricity such as due to the movement of the sheet material over rollers, interactions between rollers, etc., and if this static charge is not dissipated, the user may receive a static shock if he touches the dispenser during use, and the electronic control and sensor circuitry in the dispenser further can be affected. Still further, the operation of these dispensers often is loud, generating substantial noise during their operation.

Accordingly, it can be seen that a need exists for a dispenser that provides for a consistent controlled dispensing or feeding of desired amounts of a sheet material, and which addresses the foregoing and other related and unrelated problems in the art.

SUMMARY

Briefly described, an electronic dispenser is provided with a feed roll assembly including a motorized or driven feed roll assembly for dispensing flexible sheet material. In one aspect, the motorized or driven feed roll assembly of the dispenser can include a motorized drive or feed roller for unrolling the paper from a paper holder in response to a signal from an electronic sensor; and one or more pressing rollers, the pressing rollers at least partially engaging the driving roller as sheet material is being dispensed along a feed path between the pressing and driving rollers to a discharge chute. The motorized drive or feed roller can have a body with an internal chamber or recess defined therein, and a drive mechanism or system including a motor can be at least partially received within the internal chamber or recess of the feed roller body so as to be at least partially or substantially integrated therein, and can be operable in response to the signal from the electronic sensor to rotate the feed roll as needed to feed a measured or desired amount of paper from the roll. The drive system also can include a gear reducer assembly and one or more bearings that rotatably support the motor within the feed roller body as the feed roller is driven/rotated thereabout. The motor further may be coupled to the feed roller by a gear assembly, such as an involute spline gear assembly configured to selectively transfer torque from a driveshaft of the motor to the feed roller for the dispensing of the sheet material. However, the driven feed roll assembly may include a gear reducer assembly, which can comprise one or more planetary gear arrangements or other suitable gear reducer assembly arrangements linking the motor to the body of the feed roller. The gear assembly further may comprise or act as a hybrid or one-way clutch allowing the motor to engage and drive the feed roller, while also allowing the feed roller to be rotated independently without resistance, for example, when a selected amount of sheet material is being manually dispensed, e.g., pulled by a user.

In another aspect, the drive system including a motor may be separate from the driven feed roller. For example, the drive system can be mounted to the housing such that the drive system is position in a spaced relationship with respect to the feed roller. The drive system and feed roller may be operatively connected by one or more gears or a belt drive assembly to transfer power or torque therebetween. The drive system further may include a drive belt arrangement that can drive one or more pressing rolls in conjunction with the operation of the feed roller. For example, a drive motor, which can include a DC motor, an AC motor, stepper motor, servo motor or other similar motor or actuator (powered by a battery pack or other power source) can drive a belt gear that in turn can be coupled to and drive the feed roller. The belt gear can engage and drive the feed roll by interaction with a gear or spindle mounted to a roller shaft of the feed roller, and can further drive one or more pressing rolls by driving a belt that engages a spindle or shaft of one or both pressing rolls. The belt gear can be driven by the drive motor directly or indirectly, such as by a gear transmission assembly wherein the drive motor drives a series of gears to in turn drive the belt gear; or by a further drive belt linking the belt gear to the drive motor for driving the belt gear by operation of the motor.

In an additional aspect, the dispenser may include a cutting mechanism positioned along the feed roller and movable to at least partially cut or perforate a selected or predetermined portion of sheet material. The cutting blade may be extendable between retracted and extended positions for cutting or perforating select portions of the sheet material. The cutting mechanism can be at least partially housed within the body of the feed roller and movable into and out a slot or opening defined in the feed roller body so as to cut or perforated the sheet material. The cutting mechanism may include a cutting blade that is supported within the body of the feed roller by one or more supports or members that can be connected to one or more cam followers movable along a cam track. As the feed roller is rotated to dispense the sheet material, the cam follower may slide along or engage a surface of the cam track to move the cutting blade between extended and retracted positions into and out from the body of the feed roller, e.g., out of a slot or groove defined in the feed roller body. The cam track may be arranged along the body of a housing extending into the body of the feed roller and at least partially supporting a drive mechanism including a motor, or may be defined along one or more sidewalls or other portions of the housing exterior to the feed roller body.

In an another aspect, the dispenser also can include a pivotally mounted pawl member located proximate to the tear bar such that movement of sheet material into the tear bar for severance pivots the pawl member from a first position to a second position. A sensor or signal device cooperative with the pawl member also can be located such that movement of the pawl member to the second position causes the signal device to send a signal to notify the control circuit that the sheet material has been removed. The dispenser thus can be operative in a first mode to be responsive to a signal from the proximity sensor to dispense a sheet of material, and is operative in a second mode to dispense a next sheet in response to the signal means being activated by movement of the pawl member to the second position.

In a further aspect, the dispenser can include an adjustable proximity or other sensor for initiating operation of a dispensing mechanism, and a tear bar is mounted within the housing for severance of the sheet material by the user. A pivotally mounted pawl member further can be located proximate to the tear bar such that movement of sheet material into the tear bar for severance pivots the pawl member from a first position to a second position. A detector, sensor, switch or similar signal means or actuator that senses or is otherwise responsive to movement of the pawl member can send a signal to notify the control circuit that the sheet material may have been removed from the discharge chute upon movement of the pawl member to the second position. A paper detection sensor further can be activated by the control circuit to verify that the sheet material has been removed from the discharge chute. The dispenser thus can be operative in one mode to be responsive to a signal from the proximity sensor to dispense a sheet of material, and can further be operative in another mode to dispense a next sheet in response to a signal from the paper detection sensor that the sheet material has been removed from the dispenser.

In a still further aspect, the electronic dispenser also may operate in a number of modes, including a proximity detection mode in which a proximity sensor detects the presence of a user's hand when placed into proximity with the dispenser, and a butler mode in which the dispenser can automatically dispense another measured amount of sheet material. Additionally, the electronic dispenser can include a dispenser housing having a support for holding at least one roll of sheet material, a base for mounting to a surface, a removable cover mounted to the base, and a discharge opening for discharging the sheet material from the dispenser. A tear bar also can be mounted within the housing for severance of the dispensed amount of sheet material by the user. The dispenser further can include a control system or circuit that controls the operation of the motorized spindle or feed roller for dispensing the sheet material, and can include an adjustable proximity or other sensor.

These and other advantages and aspects of the embodiments of the disclosure will become apparent and more readily appreciated from the following detailed description of the embodiments and the claims, taken in conjunction with the accompanying drawings. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the embodiments of the present disclosure, are incorporated in and constitute a part of this specification, illustrate embodiments of the invention, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced.

DETAILED DESCRIPTION

Figure 1:
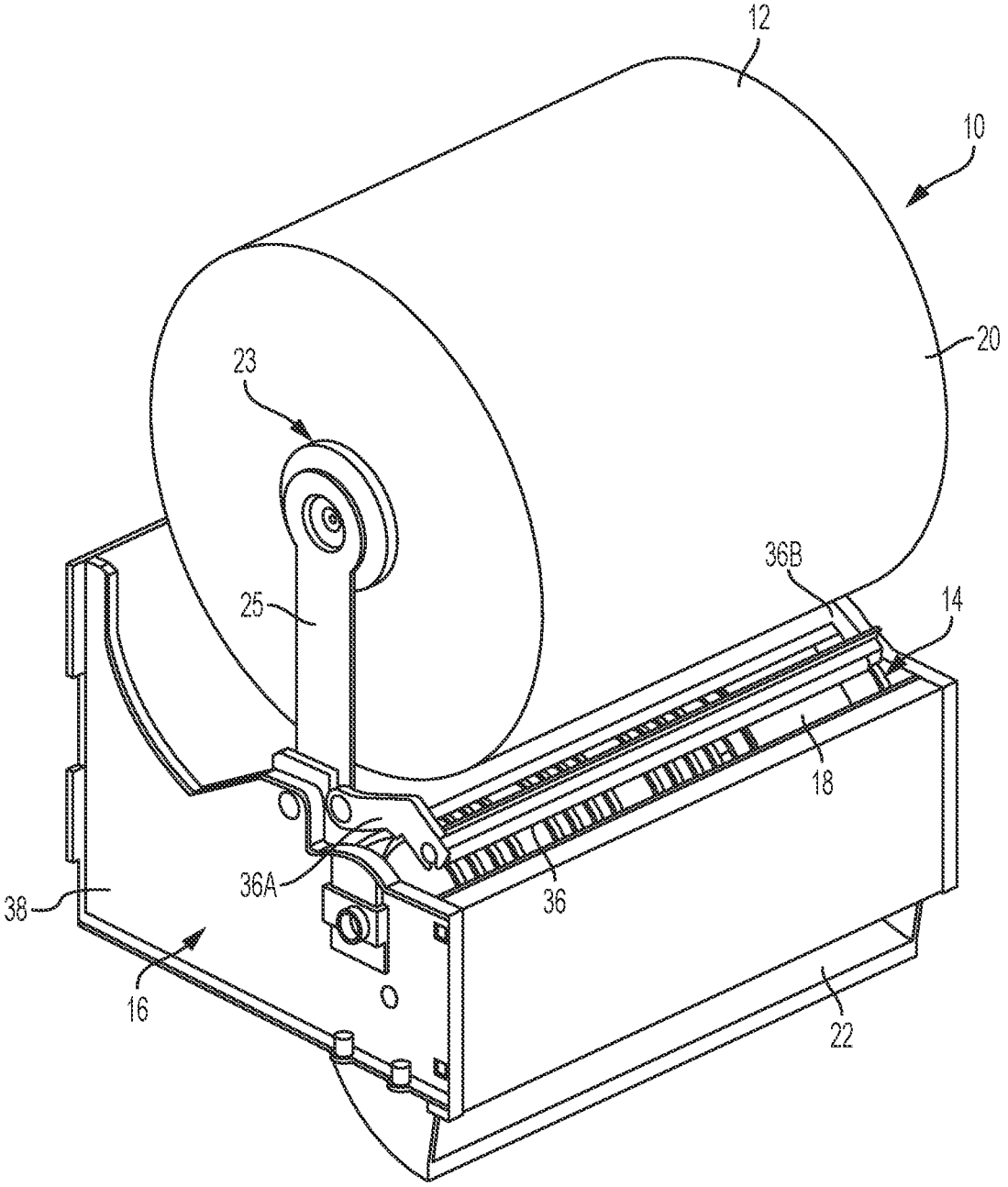
FIG. 1 shows a partial cutaway, perspective view of an example dispenser according to principles of the present disclosure.

The following description is provided as an enabling teaching of embodiments of this disclosure. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances. Thus, the following description is provided as illustrative of the principles of the embodiments of the invention and not in limitation thereof, since the scope of the invention is defined by the claims.

As generally illustrated in FIGS. 1-3, 11 and 17A, the present disclosure is directed to a dispenser 10 for feeding or dispensing a flexible sheet material 12, including a motorized or driven feed roll drive assembly 14 mounted/disposed within a dispenser housing 16. Upon activating the dispenser 10, the feed roller drive assembly 14 can be engaged, causing rotation of a motorized feed roller or drive spindle 18, thereby resulting in conveyance of a measured or selected amount or length L of sheet material 12 along a conveying or feed path P (FIGS. 2A-2D) from a roll or supply 20 of the sheet material 12 through the feed roller drive assembly 14 and out of a dispensing throat or discharge chute 22 or other suitable aperture or opening provided/defined in the housing 16, as generally indicated in FIGS. 1 and 2A-2D. It further should be appreciated that the electronic dispenser 10 described herein should not be considered to be limited to any particular style, configuration, or intended type of sheet material. For example, the dispenser 10 may be operable to dispense paper towels, toilet tissue, or other similar paper or sheet materials, including dispensing or feeding non-perforated and/or perforated sheet materials.

Figure 2A:
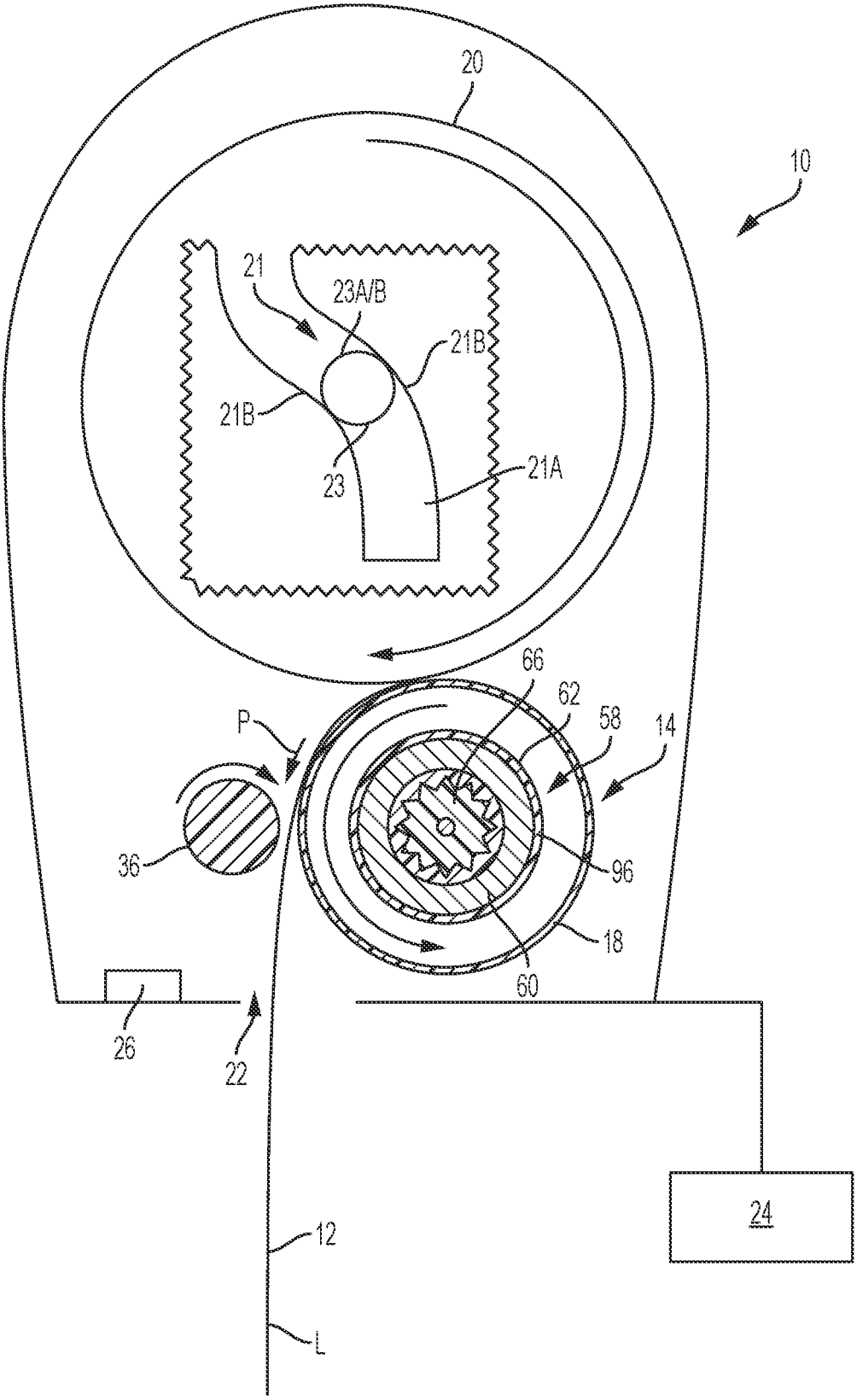
FIGS. 2A-2D show cross-sectional, partial cutaway views of example dispensers according to principles of this disclosure.
Figure 20:
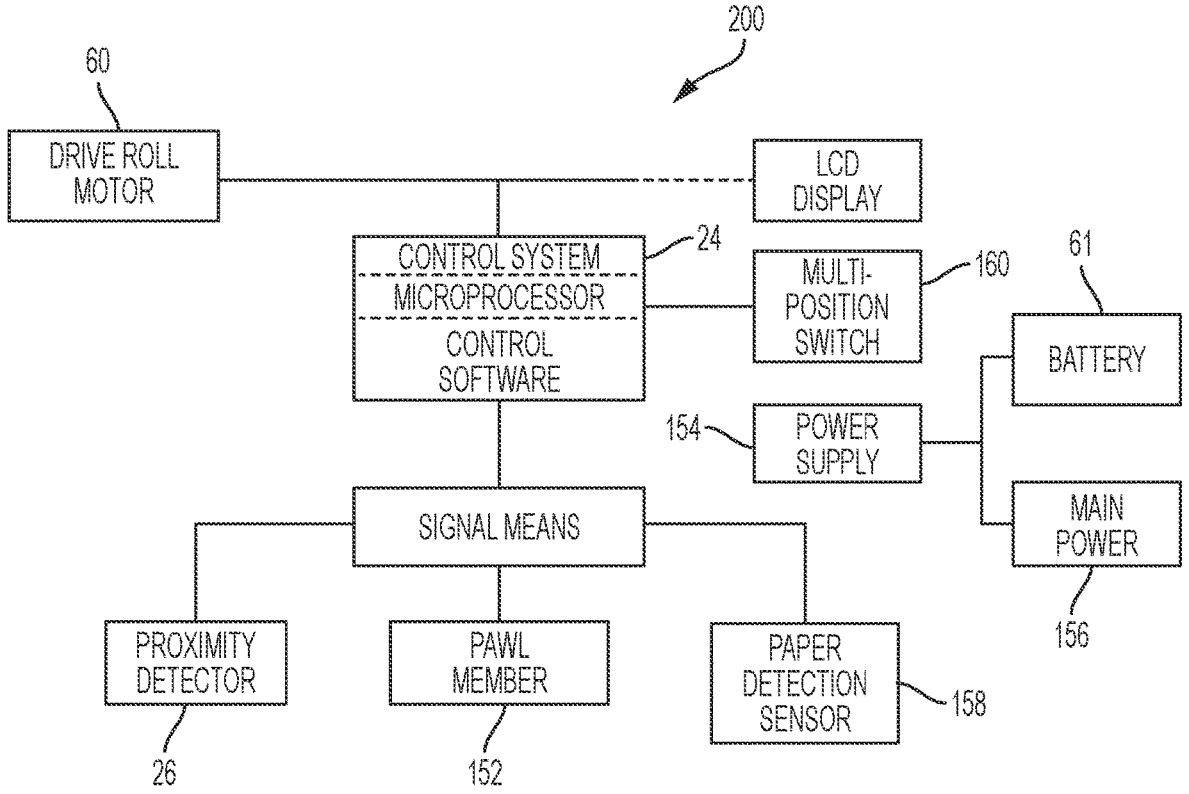
FIG. 20 shows a block diagram of an example of a control system in communication with the dispenser according to principles of the present disclosure.

FIGS. 2A-2D show examples of dispensers including the motorized or driven feed roller assembly 14 for actively feeding or driving the sheet material 12 from the supply 20 and through the discharge chute or opening 22 of the housing 16, for example, upon receiving a signal from a control system 200, which includes a controller or processor 24, as generally indicated in FIGS. 2A and 20. The controller 24 for the dispenser 10 can receive a plurality of signals from a sensor or an array or series of sensors, such as generally indicated at 26, to control dispensing of the sheet material 12. These one or more sensors 26 can include various type sensors or detectors, for example, including an adjustable proximity sensor that can be configured/adjusted to detect the presence of a user's hand at a desired range/location and dispense measured/selected amounts of sheet material 12, as well as a photoelectric, infrared (IR) or similar sensing systems/detectors, used to detect the presence of a user's hands placed below the bottom portion of the dispenser housing, and/or the feeding of a selected amount of sheet material 12.

Figure 2B:
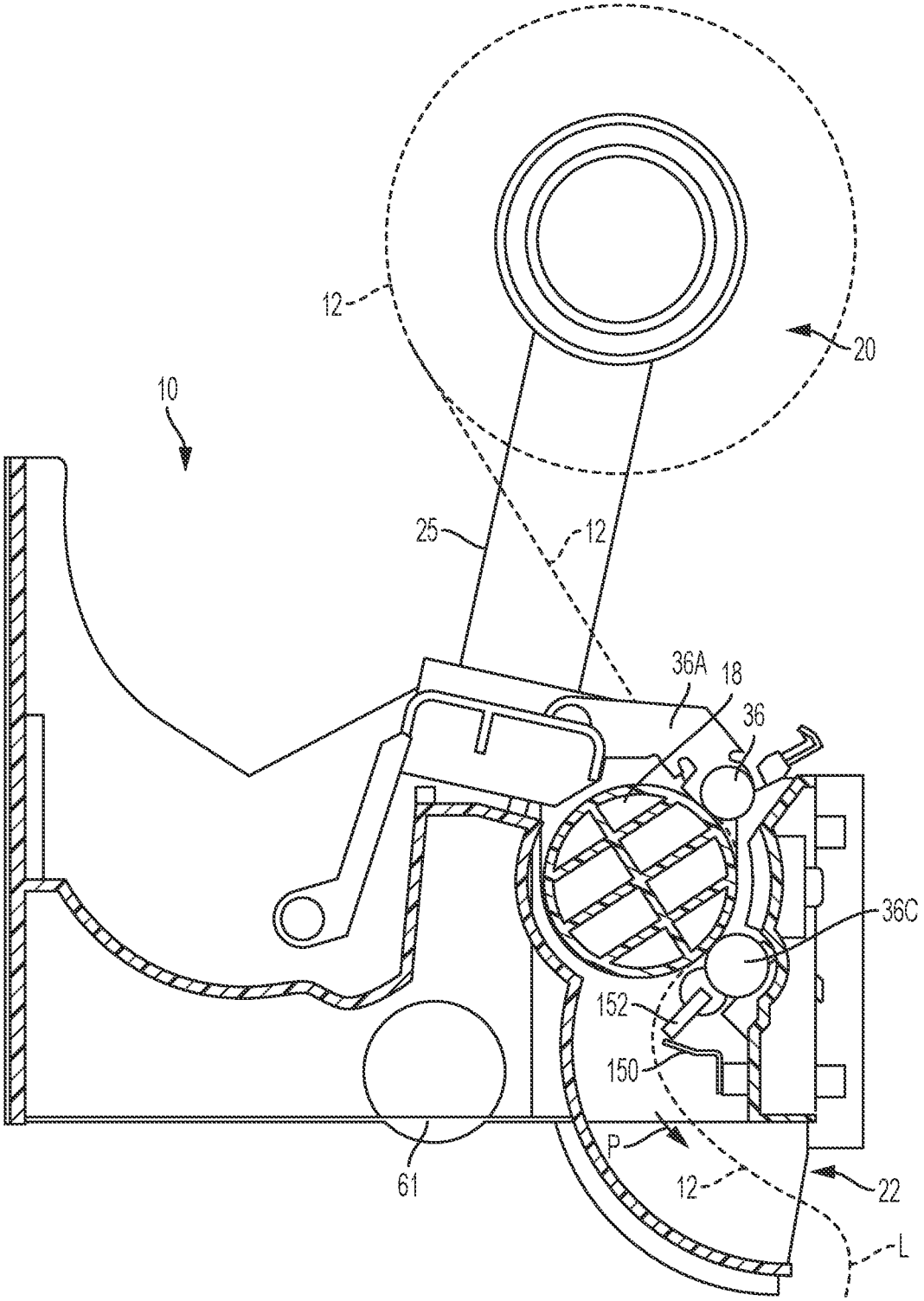

As indicated in FIG. 2A, the dispenser housing 16 also will generally include a roll support mechanism 21, for holding a core 23 of the supply 20 of sheet material 12. For example, as generally indicated in FIG. 2A, the roll support mechanism 21 can include slots or grooves 21A defined in the housing 16 configured to receive the first and/or second ends 23A/23B of the core 23 of the sheet material 12 such that at least a portion of the supply 20 of sheet material 12 is supported by, and/or rests on or engages the feed roller 18. The slots or grooves 21A of the roll support mechanism further can include one or more angled or sloped sides or portions 21B having a variable slope to increase/decrease the amount of force the supply 20 of sheet material exerts on the roller 18. For example, a slope can be selected such that as the supply 20 of sheet material is fed (e.g., the amount of sheet material 12 left on the roll decreases), the slope or position of the supply roll can change so as to keep a downward force exerted on the feed roller 18 by the supply roll substantially constant as the supply of sheet material, and likewise the weight thereof, is diminished as selected portions of the sheet material 12 are dispensed (FIG. 2B). Alternatively, as shown in FIGS. 1 and 2B, the roll 20 can be supported by a pair of arms 25 coupled to the dispenser housing 16. These arms 25 may be fixedly arranged to hold the supply 20 of sheet material in a spaced relationship with the feed roller 18 or, in the alternative, the arms 25 may be biased or urged, such as by a spring, other pre-stressed member or suitable biasing mechanisms, toward the feed roller 18 to urge or direct the supply 20 of sheet material downwardly toward or against the roller 18.

FIGS. 1-6C illustrate an example motorized drive or feed roller 18 of the embodiment of the feed roller drive assembly 14 of the electronic dispenser 10, which incorporates or comprises an integrated feed roller drive mechanism or system 58 therein. As indicated in FIGS. 3-5A and 6A-6C, the drive or feed roller 18 generally will include an elongated body 28, which can be made of a molded plastic, synthetic or other composite material, though other types of low or reduced static materials, such as wood and/or metal materials, which can include an insulating material thereabout, also can be employed.

Figure 3:
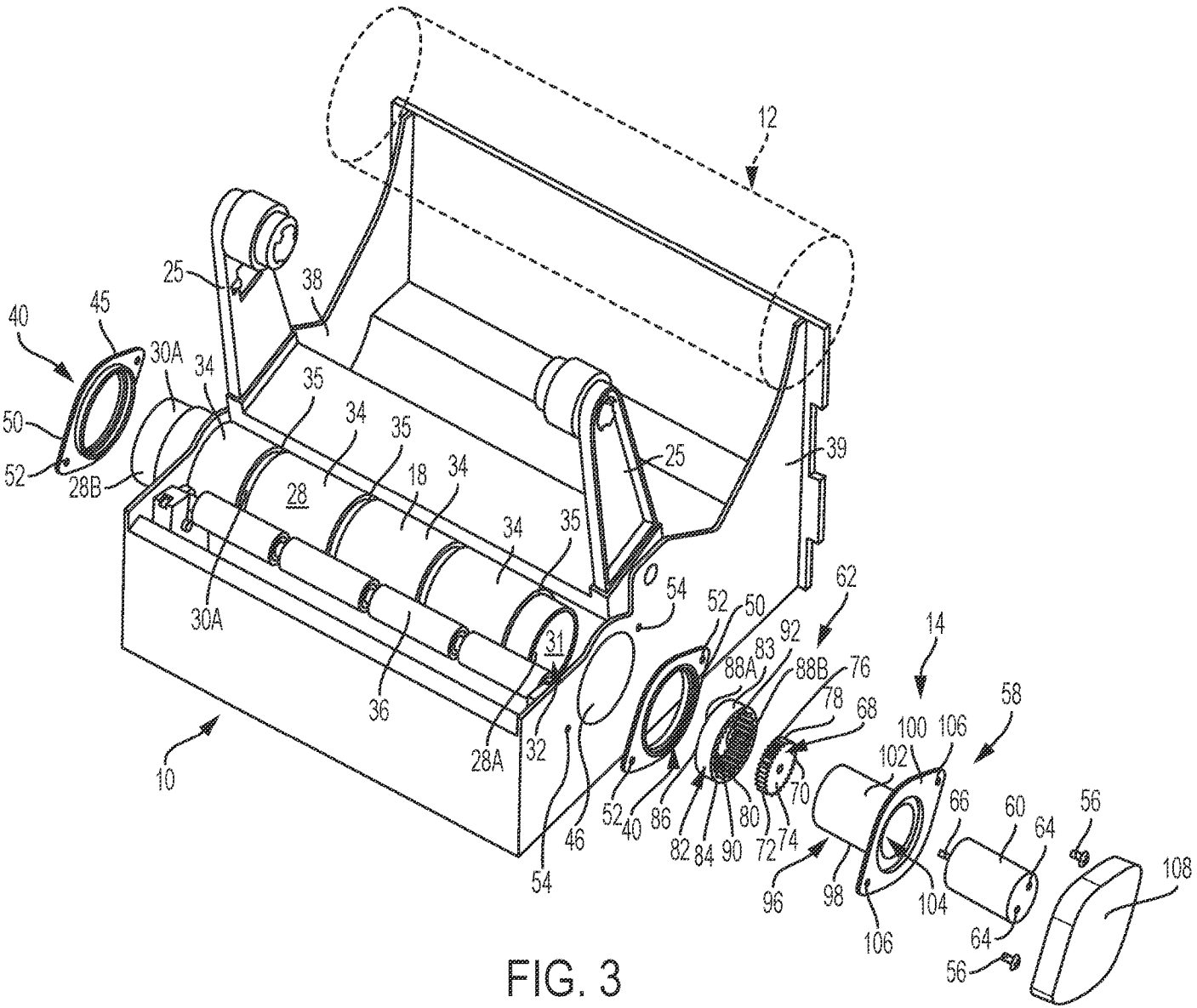
FIG. 3 shows an exploded view of the various components of the dispenser according to principles of this disclosure.

In addition, as further shown in FIGS. 3 and 6A-C, the feed roller body 28 may include first and second ends 28A/28B and a generally cylindrical outer wall 30 and an inner wall 31 defining an open ended passage, recess, or at least partially hollow cavity 32 defined within/along the feed roller body 28, and the feed roller body 28 may also include one or more driving bands or sections 34 disposed on, or adhered to, an outer surface 30A of the outer wall 30, such as a series of driving bands 34 disposed on the outer surface 30A in a spaced arrangement or configuration (FIG. 3). The driving bands 34 may at least partially include or be comprised of rubber, plastic, resin or other similar materials suitable to increase grip of the feed roller 18 and/or friction between the feed roller 18 and the sheet material 12 to thereby assist in the feeding or driving of the sheet material 12. In addition, the outer surface 30A of the feed roller body 28 also may include a series of recessed or gap sections 35 defined therein. It further will be understood that although the exemplary embodiments illustrated in FIG. 3 shows four substantially equally sized driving bands 34 disposed in a spaced relationship about the outer surface 30A of the feed roller body 28, any number, size, arrangement and/or configuration of driving bands may be used in accordance with embodiments of the present disclosure.

Figure 7A:
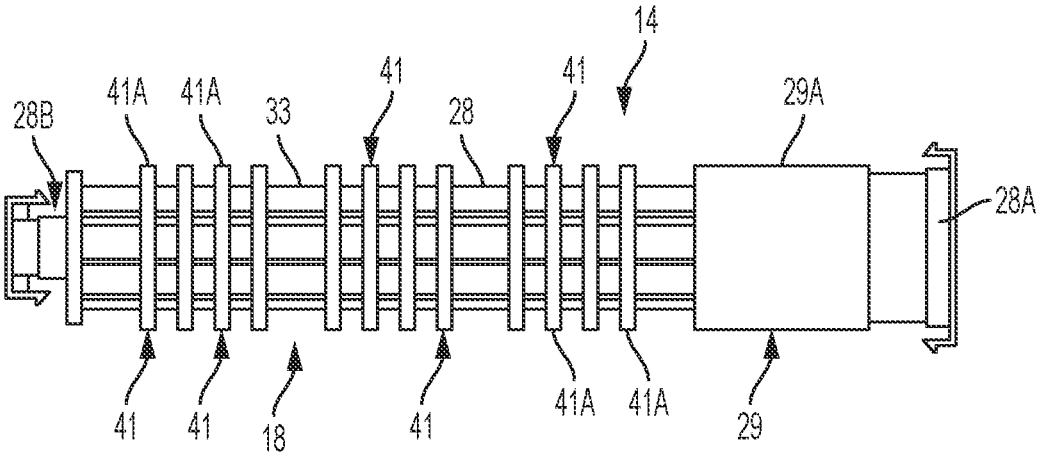
FIGS. 7A-7B show an example of a feed roller according to the principles of the present disclosure.
Figure 7B:
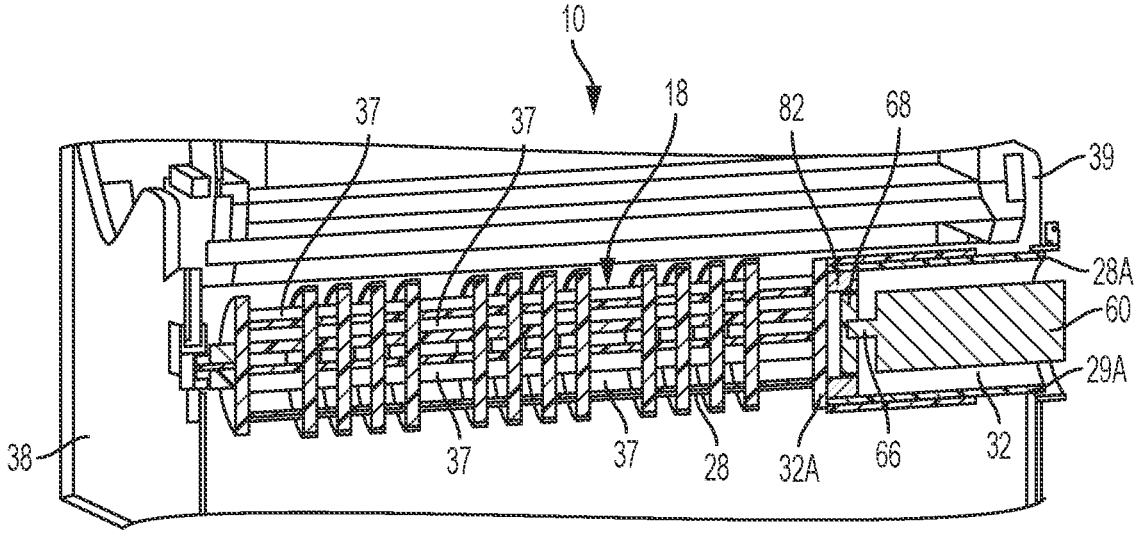

Alternatively, as generally shown in FIGS. 7A-7B, the feed roller body 28 can be made up of various sections or portions including a first section/portion 29 having, for example, a cylindrical sidewall 29A defining the open ended passage or at least the partially hollow cavity 32 therealong, and a second, or other additional, section or portion 33 connected to and/or adjacent the first section 29 and which can be formed with a series of cutouts, pockets, or cavities 37 therein. Such a configuration may provide increased stiffness of the feed roller body 28, while also reducing the amount of material required for production, and thus potentially can help decrease manufacturing costs. The second portion/section 33 also may have a series of contact portions or flanges 41 disposed/arranged therealong, each with a contact surface 41A for engaging/driving the sheet material 12 as the feed roller body 28 is driven/rotated to feed the sheet material 12.

Figure 2C:
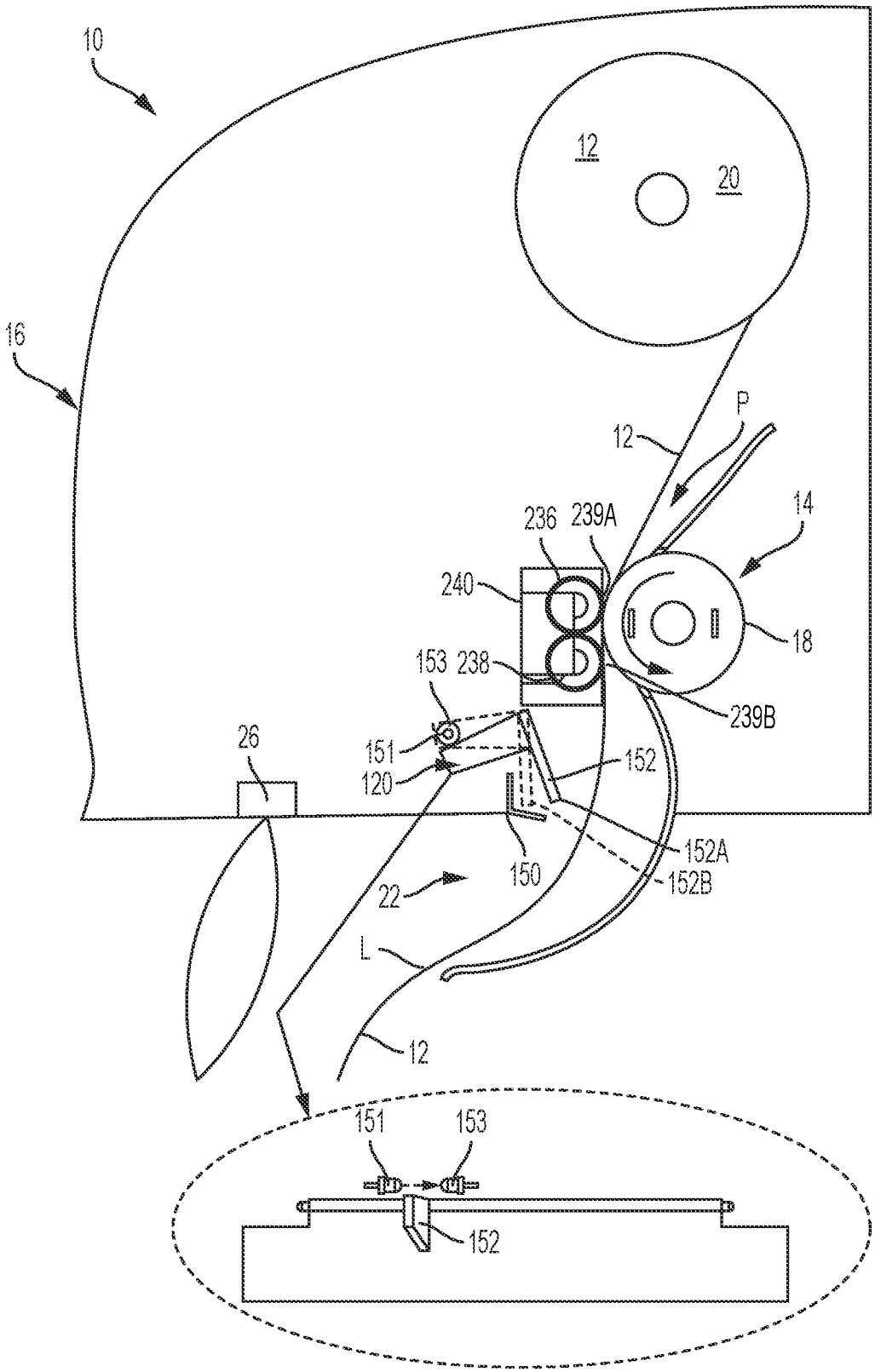
Figure 2D:
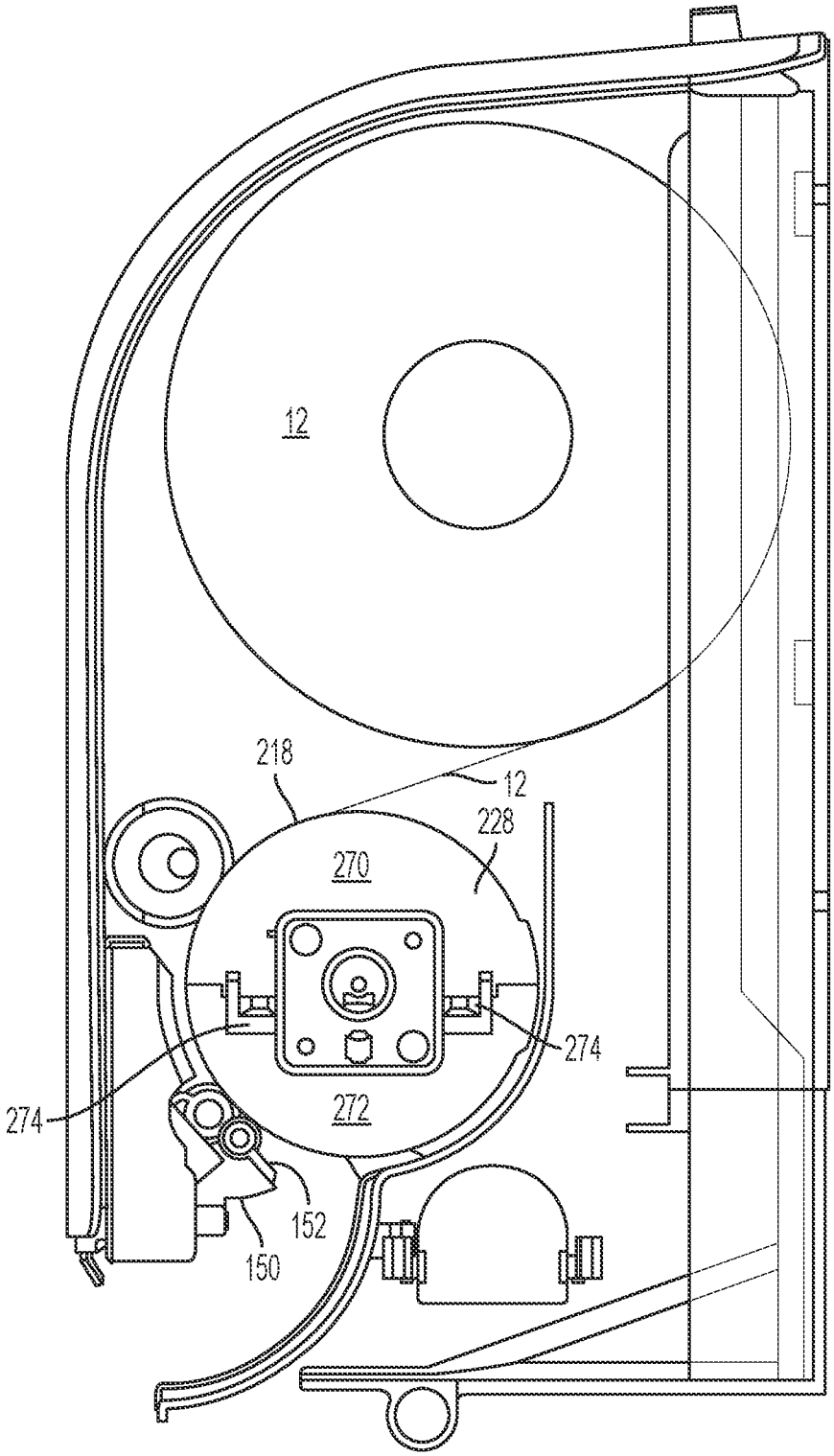

FIG. 2D additionally shows that the feed roller body 228 can be made up of multiple sections that can be removably coupled or connected to one another so as to provide increased access to the components housed within the feed roller body 228 and/or to allow for more efficient assembly/manufacture of the feed roller body 228 and the components housed therein. For example, the feed roller body 228 can include a pair of hemispherical, modular portions or sections 270 and 272 that can be removably secured into place/together by one or more connecting portions 274, such as a snap fit configuration or other suitable connection or locking mechanism.

As shown in FIG. 3, the feed roller body 28 can be movably or rotatably mounted/attached to one or more walls or other portions of the dispenser housing 16, such as side walls 38/39. The first 28A and/or second 28B ends of the feed roller body 28 can be connected, mounted or otherwise coupled to the side walls 38/39 by one or more bearing assemblies 40, and/or including other suitable support mechanisms that support and allow for rotation of the feed roller body 28 in relation to the dispenser housing 16. The bearing assemblies 40 may include roller or ball bearings that can be contained, housed or otherwise disposed between bands or rings defining a bearing assembly body 45. Embodiments of this disclosure are not, however, limited to roller/ball bearings, however, and may include plain, fluid, or magnetic bearings or any other suitable mechanisms for rotatably fixing the feed roller body 28 to or within the dispenser housing 16.

Figure 6A:
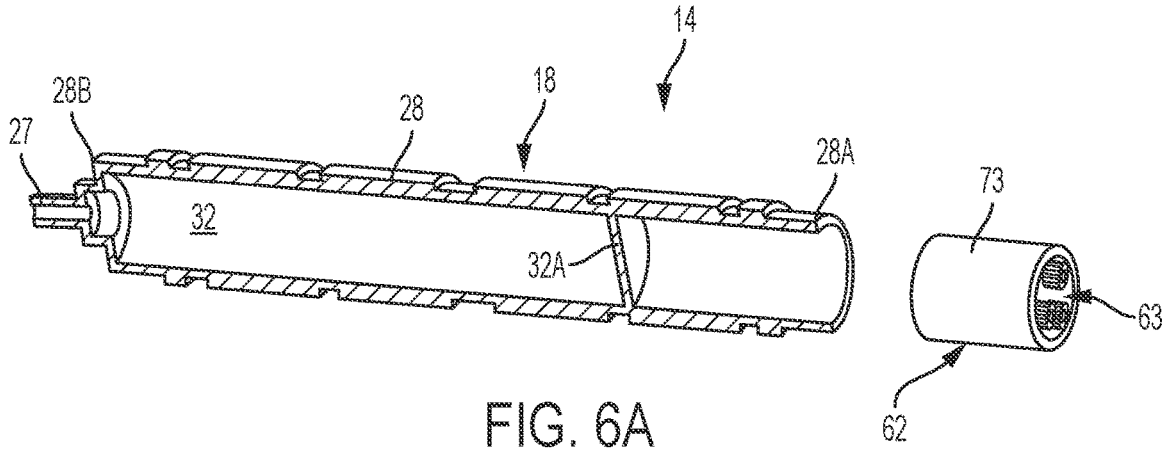
FIGS. 6A-6C illustrate one example construction of a driven feed roller assembly according to principles of this disclosure.
Figure 6B:
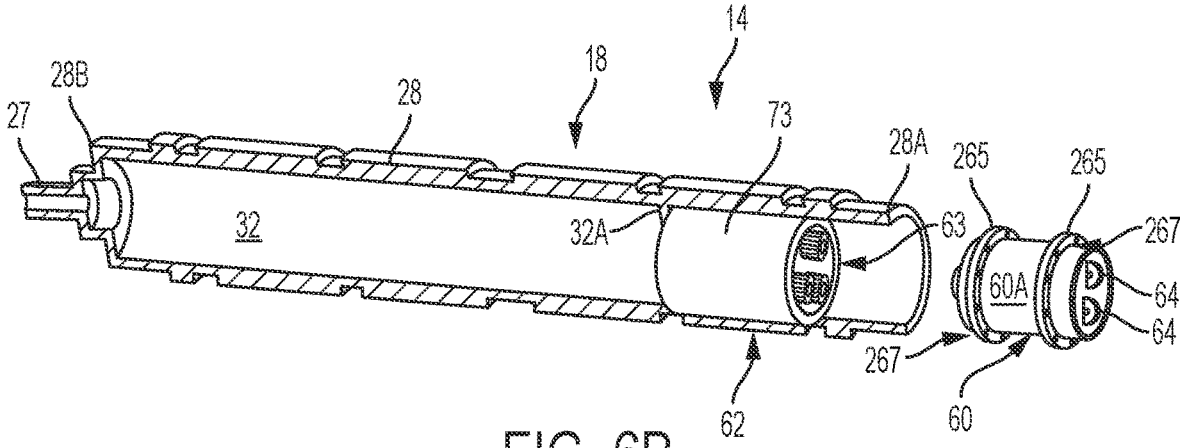
Figure 6C:
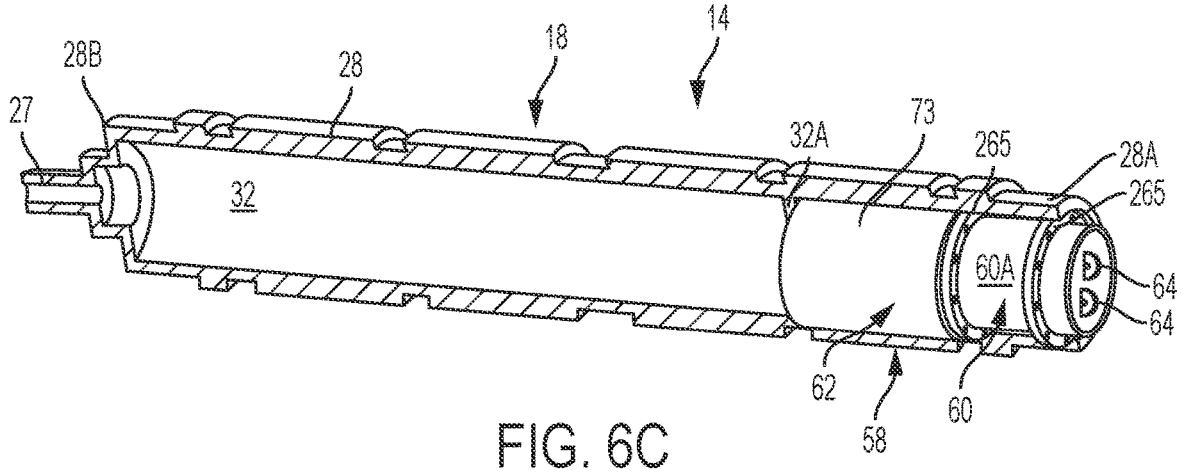

The first 28A and/or second 28B ends of the feed roller body 28 also may be rotatably mounted to the sides of the housing 16 by the bearing assemblies 40. For example, the first and/or second ends 28 A/B of the feed roller body 28 can be received through and engage the bearing assemblies 40 so as to be movable therein to enable the feed roller body 28 to rotate with respect to the dispenser housing 16. Though FIG. 3 shows the feed roller body 28 attached to the dispenser housing 16 at both the first and second ends 28 A/B, embodiments of the present disclosure are not limited to this arrangement and the feed roller body 28 can be attached to the dispenser housing 16 in any suitable manner. For example, an axle or shaft 27 may be engaged or otherwise affixed to or integrated with one, or both, of the ends 28A/B (e.g. the second end 28B) of the feed roller body 28, and further can be rotatably mounted to one of the sidewalls 38/39 of the housing 16, such as by a hub and/or bearing assembly or other suitable connection (FIGS. 6A-C).

Figure 4A:
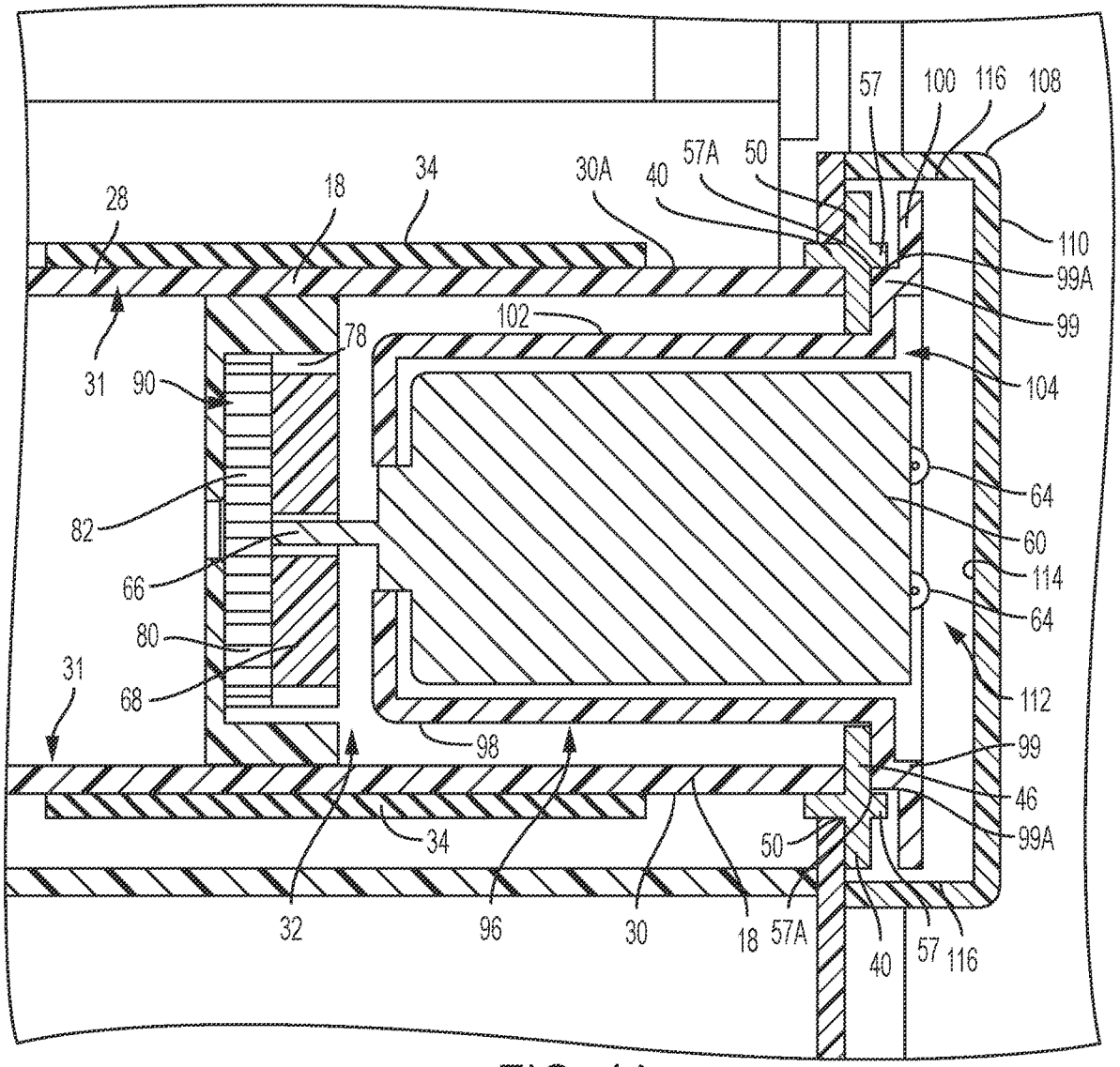
FIG. 4A schematically illustrates a cross-sectional view of a feed roller drive assembly for a dispenser such as shown in FIG. 3.

Referring to FIG. 3, the bearing assemblies 40 also can be at least partially received or housed within apertures or openings 46 defined in the side walls 38/39 of the dispenser housing 16, and each can include a flange or support portion 50 for connecting the bearing assemblies to an outer surface 38A/39A of the sidewalls 38/39 of the dispenser housing 16. In one example, the flange portions 50 may have a series of openings or apertures 52 defined or formed therein, which openings 52 are disposed/arranged to be substantially aligned with corresponding openings or apertures 106 and 54 defined or formed in flanges 100 of a motor bracket or housing 96 and in side walls 38/39 of the dispenser housing 16. These openings can be further configured to receive fasteners, such as screws or bolts 56, to fixedly connect the flange portion 50 of the bearing assemblies 40 to the side walls 38/39 of the dispenser housing 16, and further mount the motor housing 96 thereover and to the housing 16 as shown in FIG. 4A. Other fasteners, including rivets, snaps, etc., also can be used. The flanges 50 of the bearings further may alternatively be fixed/secured to the sidewall 38/39 of the dispenser housing 16 using an adhesive or, alternatively, may be integrally formed with the dispenser housing 16.

As illustrated in FIGS. 1-3 and 8A-8B, the dispenser 10 further generally can include one or more pressing rollers 36,236,238 that can be biased toward engagement with the feed roller 18, so as to engage and force or press the sheet material 12 against the feed roller 18. The pressing roller(s) 36 can be movably mounted within the dispenser housing 16, such as with the ends thereof held within holders or brackets 36A/36B that can be biased toward engagement with the driven feed roller 18 such as by springs, biased cylinders or other suitable biasing mechanisms. The pressing rollers or a single roller where used, also can be biased independently toward the feed roller. The pressing roller(s) 36 further can include bands of a gripping material, such as a rubber or synthetic material, to assist in pulling the sheet material therebetween without causing damage to the sheet material as it passes between the feed roller and pressing roller(s). Additional pressing or guide rollers also can be arranged along the feed roller 18 to assist in guiding the sheet material, which additional rollers 36B (FIG. 2B) may be fixed or biased against the feed roller body 28, such as by springs, biased cylinders or other suitable biasing mechanisms (FIG. 2B).

Figure 8A:
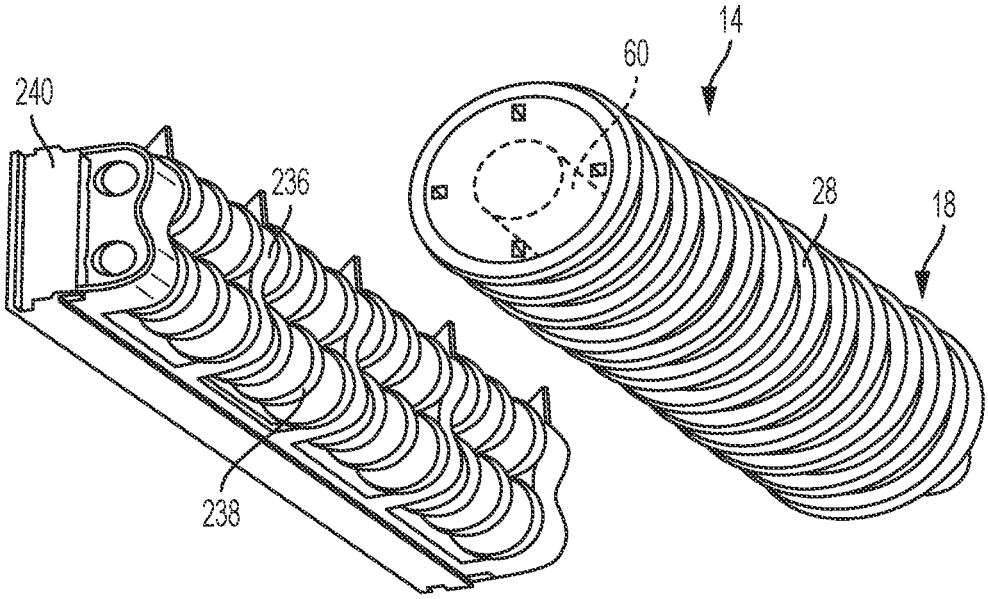
FIGS. 8A-8B illustrate perspective views of an example arrangement of feed and pressing rollers according to principles of this disclosure.
Figure 8B:
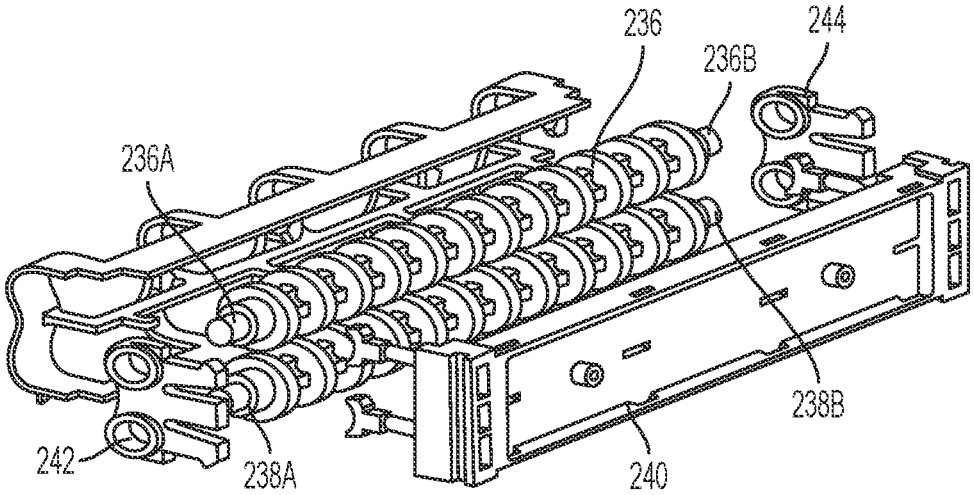

For example, a series of pressing rollers 236, 238 can be biased toward engagement with the feed roller 18, as indicated in FIGS. 8A-B, to engage the sheet material against the feed roller 18. The pressing rollers 236, 238 can be movably mounted within a housing 240, such as with the ends thereof (236A-B, 238A-B) held within holders or brackets 242, 244 that can be biased toward engagement with the feed roller 18 by springs; cylinders or other suitable biasing mechanisms. The engagement of the pressing rollers 236, 238 and feed roller 18 will define nip points 239A, 239B, as indicated in FIG. 2C, at upstream and downstream points along the feed path P of the sheet material 12 as the sheet material 12 is engaged and fed between the feed roller 18 and the pressing rollers 236, 238 of the motorized or driven feed roll assembly 14. The pressing rollers 236, 238 further can include bands of a gripping material, such as a rubber or synthetic material, to assist in pulling the sheet material therebetween without causing damage to the sheet material as it passes between the feed roller and pressing rollers.

Figure 9A:
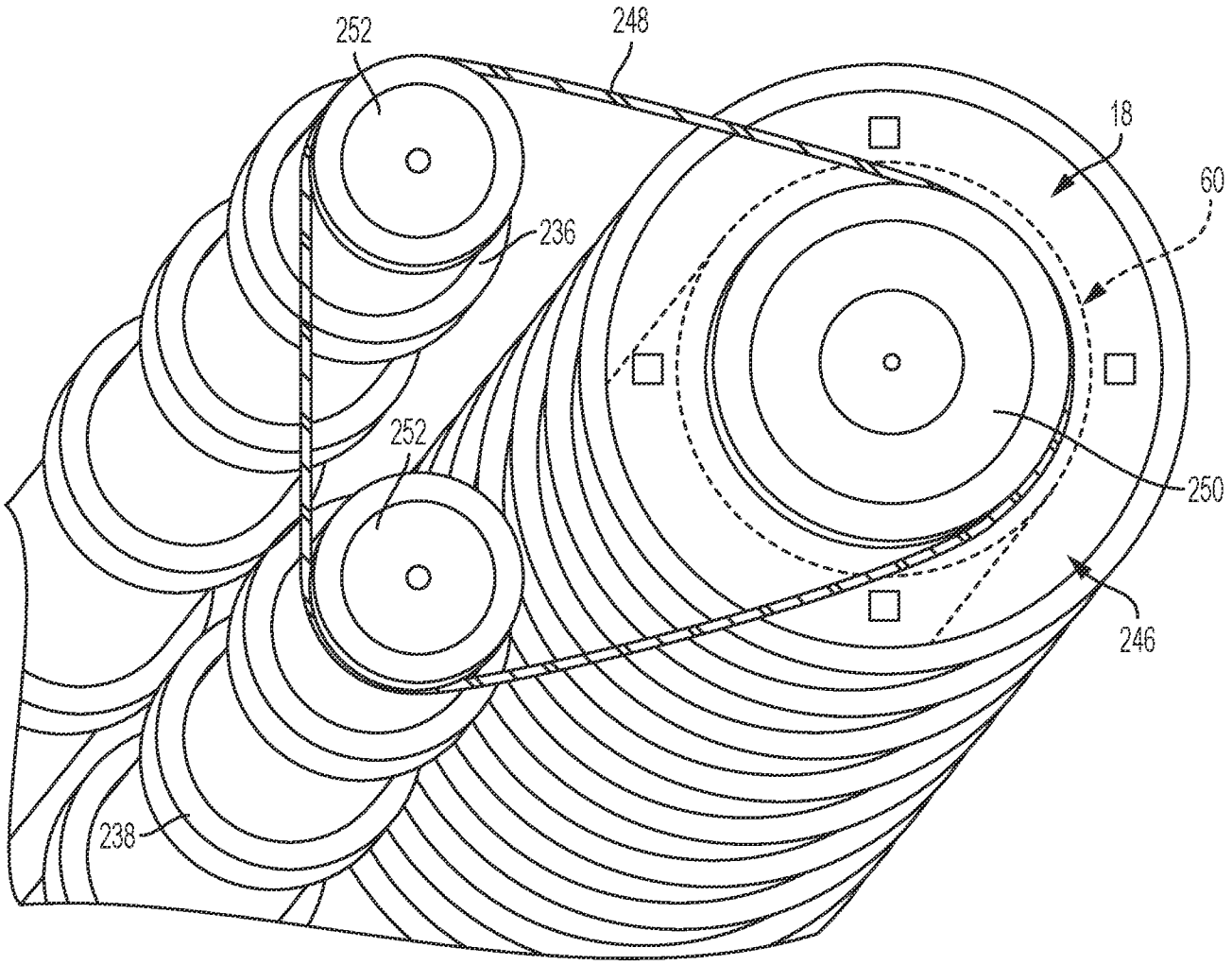
FIGS. 9A-9B show example drive mechanisms/arrangements for driving the pressing rollers according to principles of this disclosure.
Figure 9B:
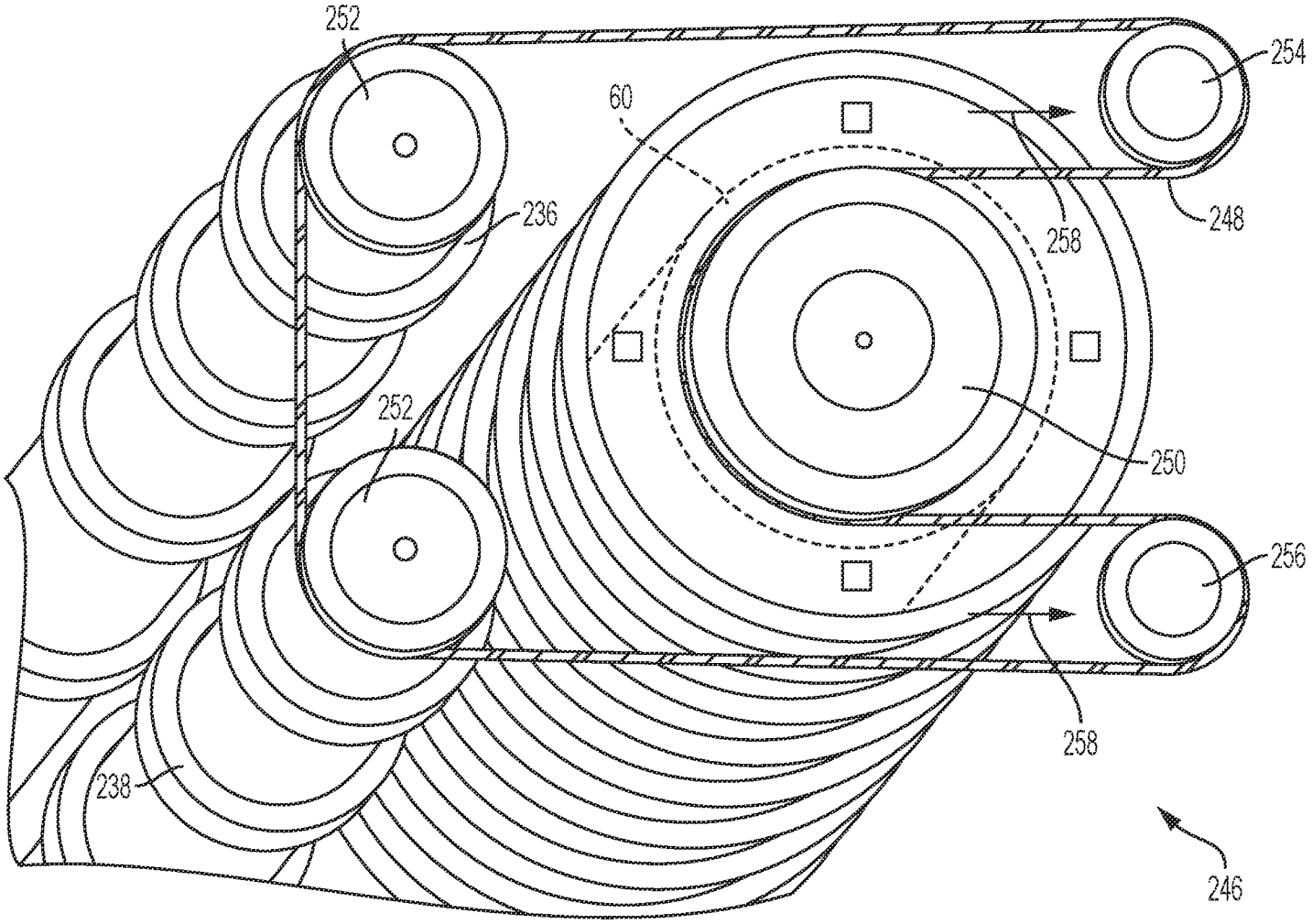

In addition, the pressing rollers 236, 238 may be driven by the motor 60 of the feed roller 18 so as to facilitate feeding of the sheet material 12. For example, as shown in FIGS. 9A-9B, the pressing rollers 236, 238 may be connected to a drive belt assembly 246 that is operatively connected to the motor 60 to transfer torque/power between the motor 60 and the pressing rollers 236, 238. The drive belt assembly 246 can include a drive belt 248 that engages a belt gear, sleeve or pulley 250 fixed or otherwise connected or coupled to the feed roller 18 (so as to be driven thereby) and a series of belt gears, sleeves, or pulleys 252 fixed or otherwise connected to the pressing rollers 236, 238, e.g., at one or more ends 236A-B or 238A-B of the pressing rollers (FIG. 9A). In addition, the drive belt mechanism 246 further can include tensioning or idler pulleys, sheaves, gears, etc. 254/256 arranged/positioned adjacent the belt gear 250 fixed to the feed roller 18 and engaging the drive belt 248 (FIG. 9B). The pulleys 254/256 may be biased or urged in a predetermined direction (e.g., away from the pressing rollers as indicated by arrows 258) by a biasing member, such as one or more springs, to provide a substantially constant biasing force against, or to otherwise substantially maintain tension along, the drive belt 248. The magnitude of this biasing force or degree to which the drive belt 248 is tensioned may be selected such that the pressing rollers 236, 238 are urged toward and substantially maintained against and in contact with the feed roller 18, and/or so that the drive belt 248 is sufficiently tensioned to help prevent slippage between the drive belt 248 and the belt gear or belt pulleys 252 of the pressing rollers 236, 238.

Embodiments of the present disclosure described herein can also utilize concepts disclosed in commonly-owned U.S. Pat. No. 7,213,782 entitled "Intelligent Dispensing System" and U.S. Pat. No. 7,370,824 entitled "Intelligent Electronic Paper Dispenser," both of which are incorporated by reference in their entireties herein. The embodiments also utilize concepts disclosed in published patent applications US 2008/010098241 entitled "System and Method for Dissipating Static Electricity in an Electronic Sheet Material Dispenser," "Electronic Dispenser for Flexible Rolled Sheet Material," and US 2014/026381241, entitled "Electronic Residential Tissue Dispenser," all of which are incorporated by reference in their entireties herein.

The driven feed roller assembly 14 will include the feed roller drive assembly/system 58, which can be at least partially received or housed within the open ended cavity or recess 32 of the feed roller body 28 so as to be substantially integrated with the feed roller 18 as generally illustrated in FIGS. 4A-4B and 5A-6C. The drive assembly 58 will include a driving mechanism, such as motor 60, and can include a gear arrangement/assembly 62 for transferring power generated by the motor 60 to the rotatable feed roller 18. The motor 60 can include a brushless servo or stepper motor or other, similar type of adjustable, variable speed electric motor, and can have connectors, such as a plug-in type connector including a pair of spaced prongs 64 (FIGS. 4A-4B) or other, similar connection through which the motor 60 can communicate with the control system of the dispenser and through which the motor 60 can receive instructions and power for driving the feed roller 18 so as to feed a selected or desired amount or length of sheet material through the discharge opening of the dispenser. The motor 60 can additionally provide feedback to the controller 24 (FIG. 20) of the dispenser control system 200, for example, to indicate a jam or misfeed and/or to further enable the controller 24 to monitor movement of the feed roller and thus control feeding of the sheet material. The motor also can include additional connecting leads or members to operatively connect the motor 60 to a power source, including, for example, one or more batteries 61 (FIG. 20) or an electrical outlet.

Figure 5A:
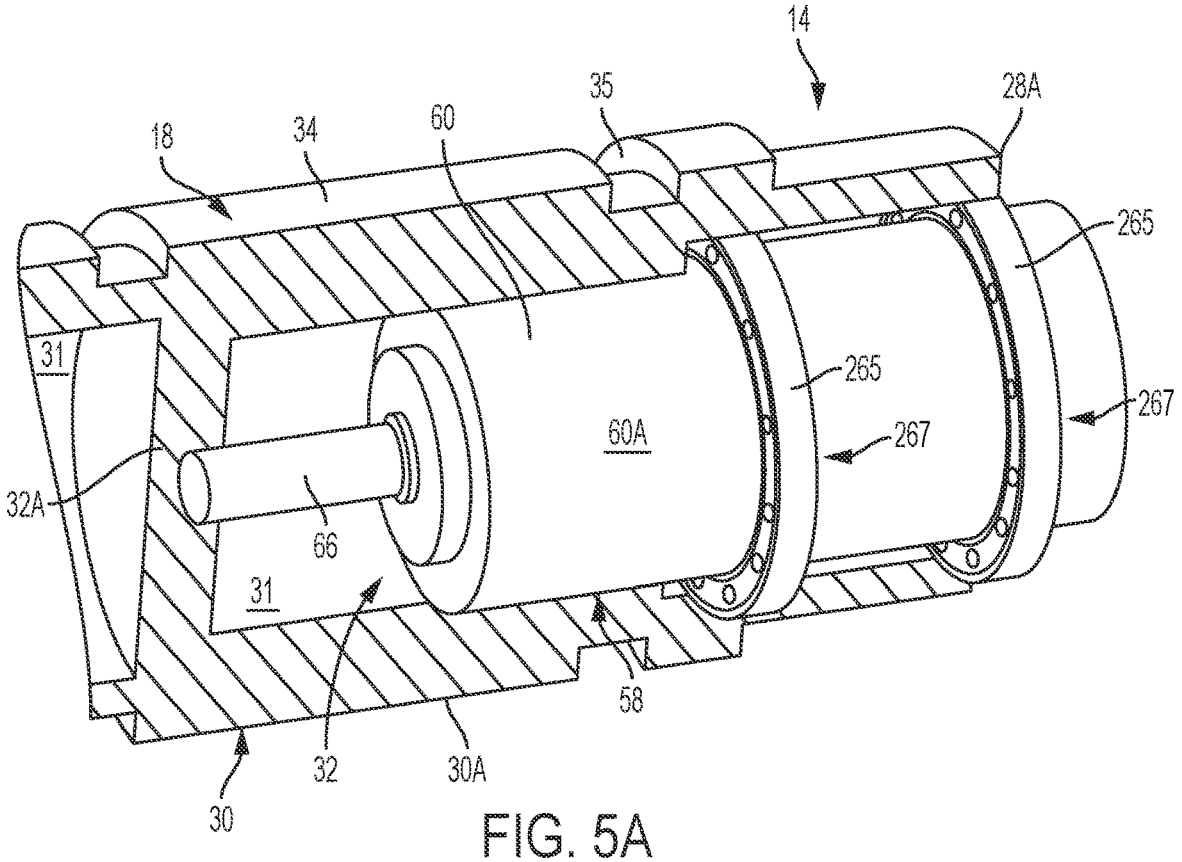
FIG. 5A illustrates example driving elements of a feed roller drive assembly according to principles of this disclosure.

As shown in FIG. 5A, the motor 60 can have a drive shaft 66 that connected directly to an interior partition or other portion 32A of the feed roller 18 so as to directly drive the rotation of the feed roller. The motor further can be mounted within the cavity 32 of the feed roller or bearing mounts which enable the motor 60 to remain substantially stationary as the feed roller 18 is driven and rotates thereabout. In addition, the drive assembly 58 also can include a gear arrangement/assembly 62 coupled to, or otherwise in communication with, the motor 60 to transfer and/or regulate or control power/torque from the motor 60 to the feed roller 18. This could include a gear reducer or other driving assembly to vary torque/driving force output from the motor and communicated to the feed roller.

Figure 4B:
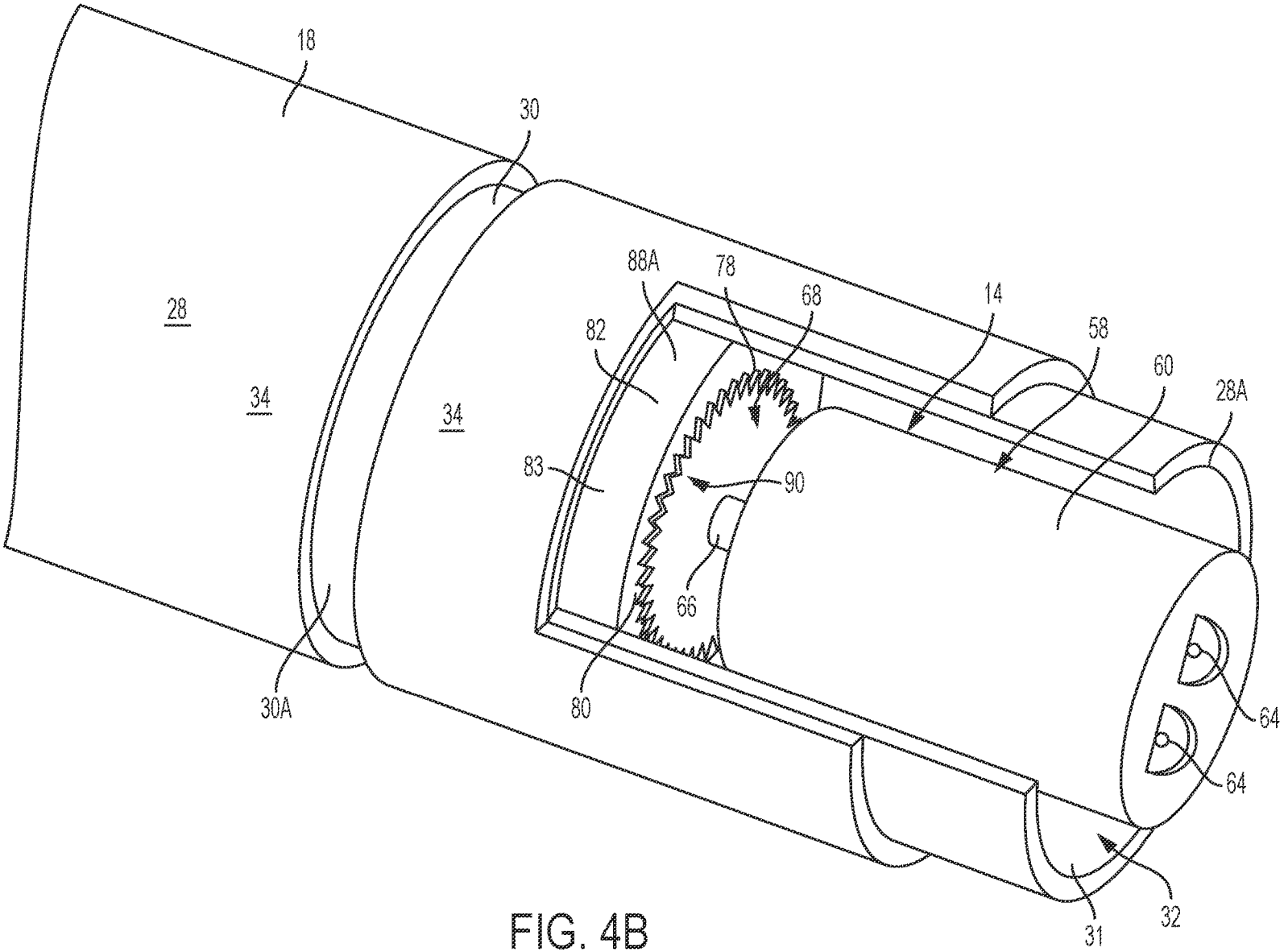
FIG. 4B provides a partial cutaway view of a feed roller drive assembly housed within the feed roller body of the dispenser according to FIG. 3.

In one example, the gear arrangement/assembly 62 may include an involute spline gear arrangement or configuration 62 (FIGS. 3 and 4A-4B). For example, as shown in FIG. 4A, the motor 60 generally may include the driveshaft 66 with a drive gear 68 of the gear arrangement/assembly 62 (FIGS. 4A-4B, 5B and 6A-6C) connected thereto, which drive gear 68 can include a drive gear body 70 with front 74, rear 76 and circumferential 72 sides or surfaces, and a series of gear teeth 78 disposed about/defined in the circumferential side/surface. The drive gear 68 can be receivable within a roller or spline gear 82, with the gear teeth 78 of the drive gear 68 generally configured to be matable with and engage a series of gear teeth 80 of a roller gear 82 coupled to, or otherwise communication with, the feed roller 18. The roller gear 82 generally will have a gear body 83 with front 84, rear 86 and outer/inner circumferential 88A/B surfaces or sides, and with an internal recess, cavity or opening 90 defined in the front surface 84 of the gear body 83, which recess 90 may be sized, dimensioned and/or configured to at least partially receive/house the drive gear 68 coupled to the driveshaft 66. The recess 90 generally may be defined by a substantially flat inner surface/side 92 and the substantially circular inner circumferential surface/side 88B, with the gear teeth 80 of the roller gear 82 defined/formed therealong.

Figure 11:
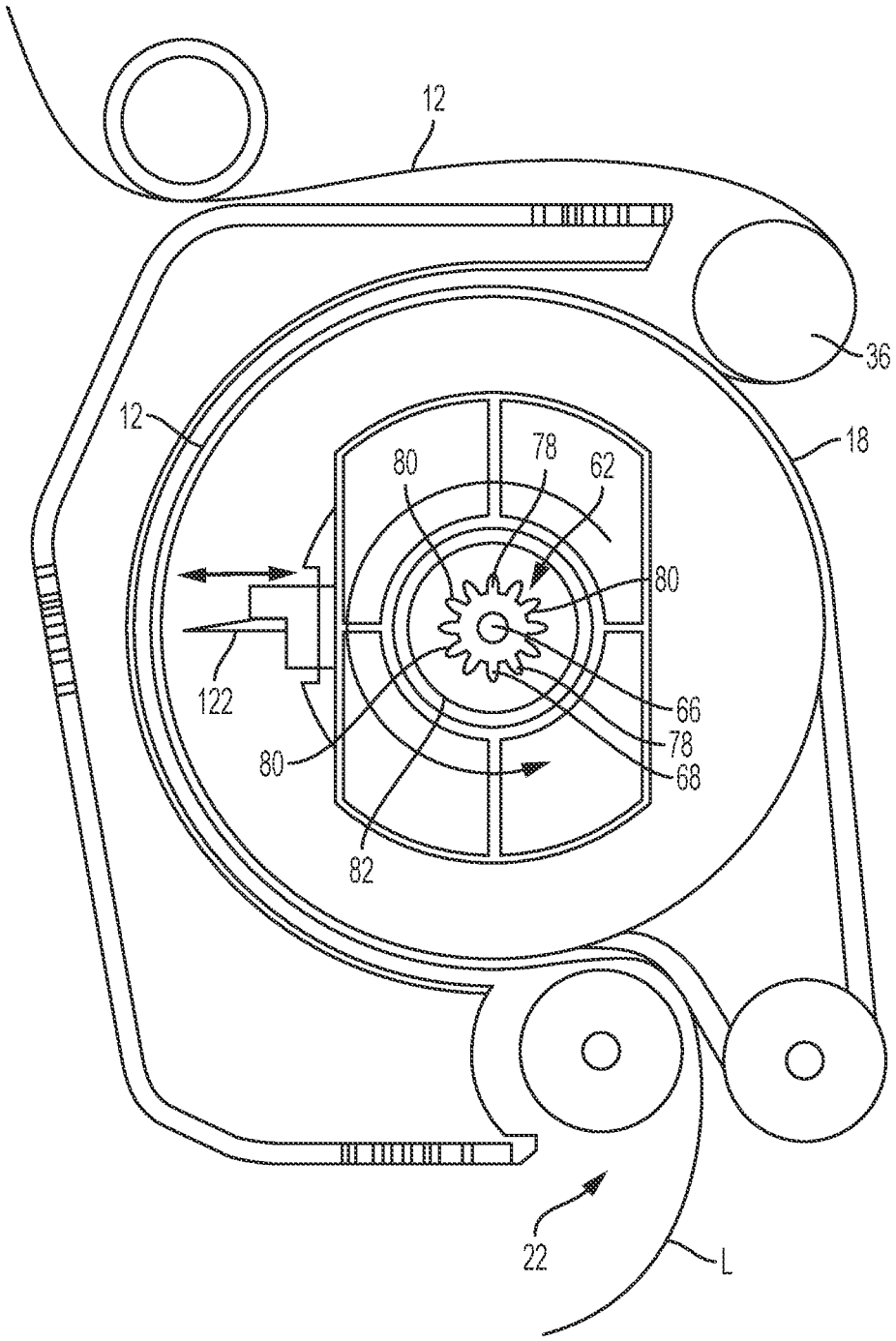
FIG. 11 provides a cross-sectional view of the feed roller drive assembly according to principles of this disclosure.
Figure 14:
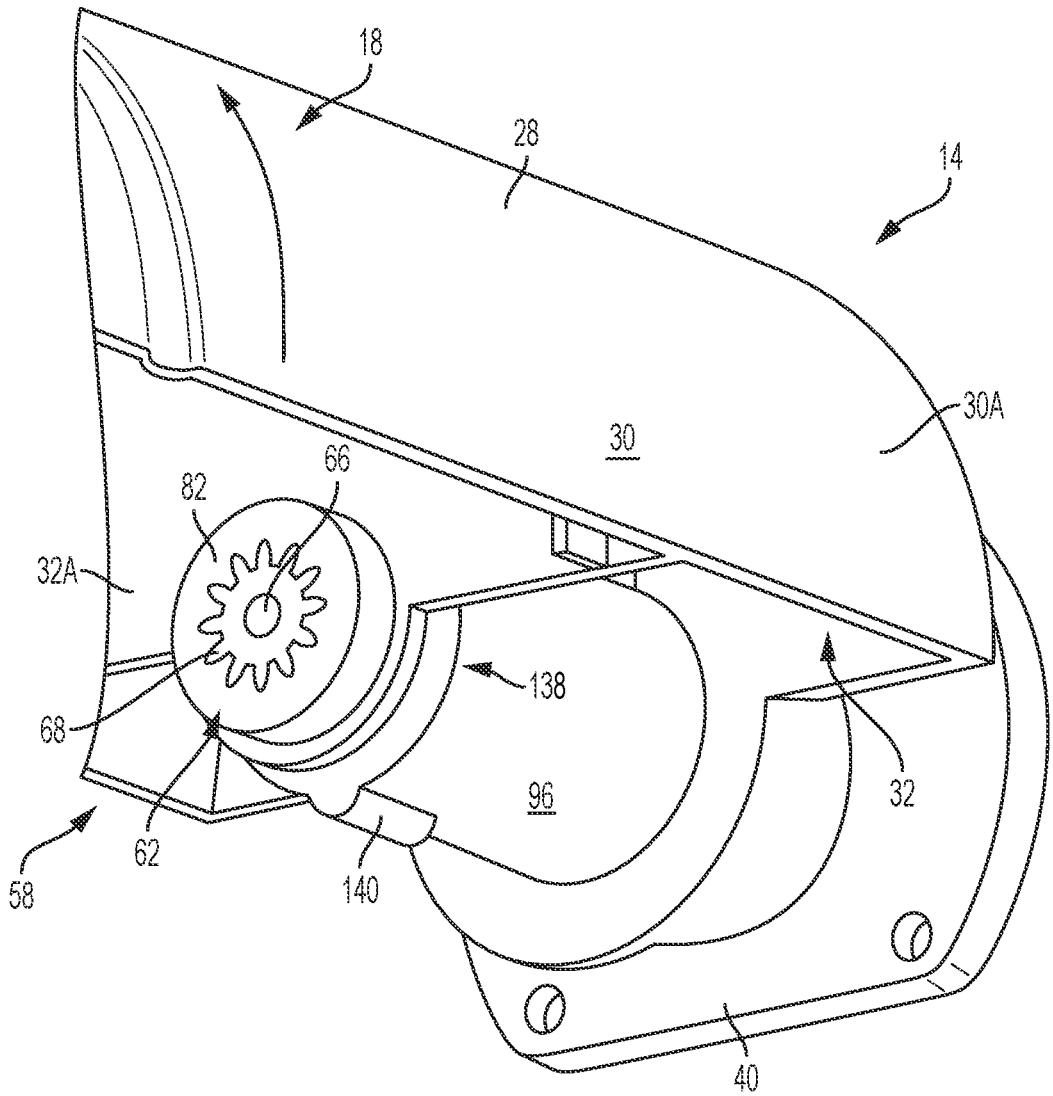
FIG. 14 illustrates a cutaway view of the drive assembly housed within the feed roller illustrated in FIG. 3.

Accordingly, as indicated in FIGS. 11 and 14, the drive gear 68 can be at least partially received within the recess 90 of the roller or spline gear 82 (FIGS. 4A-4B) so that the rear surface 76 (FIG. 3) of the drive gear body 70 is substantially adjacent and opposes the inner surface 92 of the roller gear 82 such that the teeth 78 of the drive gear 68 generally are mated or engaged with the teeth 80 of the roller gear 82, so that as the motor 60 drives/turns the drive gear 68, the teeth 78 of the drive gear 68 engage the teeth 80 of the roller gear 82 to transfer torque/power from the motor 60 to the roller gear 82 to drive the roller 18. The gear ratio between the arrangement/configuration of the teeth 78 of the drive gear 68 and the teeth 80 of the roller gear 82 may be set as needed to provide a desired driving force. For example, in some embodiments, the gear ratio can be approximately one-to-one (1:1) so as not to change the transmission of power or torque from the motor 60. However, other gear ratios can be utilized without departing from the present disclosure, such as gear ratios greater than, or less than, one to one (1:1) as needed to increase and/or decrease the power or torque transmitted from the motor 60 so as to allow for the use of, for example, smaller less powerful motors. Such an involute spline gear arrangement further can assist in the manufacturing of the dispenser 10 as relatively higher deviations may be permitted in the tolerances between the drive and roller gears 68/82, and such that the manufacturing thereof does not require substantially close, tight/restrictive tolerances that often come with other driving arrangements. It also will be understood that other gear drive arrangements, such as, by way of example, a planetary gear drive arrangement (FIG. 5B), can be provided as needed to adjust, reduce or increase the driving force provided by the motor for driving the feed roller.

The gear arrangement/assembly 62 (FIGS. 13-14) further can be constructed or configured to act as a hybrid or one-way clutch assembly to allow for selective transfer of torque/power between the motor 60 and the roller 18 and/or allow for the roller 18 to freely rotate absent resistance of the motor 60. For example, when the motor 60 is powered on, the clutch assembly may lock/engage so to initiate communication between or operatively connect the drive gear 68 and roller gear 82 and provide transfer of power/torque between the drive gear 68 and the roller gear 82 thereby allowing rotation or driving of the roller 18 under the power of the motor 60. When the motor 60 is powered off, such as by being manually turned off or due to experiencing a loss of power or a low power condition, the clutch assembly may unlock or disengage such that there is no communication or operative connection between the drive gear 68 and the roller gear 82 to thereby allow for rotation of the roller 18 without resistance caused by rotation of the motor 60 so as to allow for manual dispensing of the sheet material, when a user applies a relatively small force thereto. The clutch assembly also may selectively disconnect/disengage the motor 60 if the sheet material is pulled as the motor 60 is driving the roller 18 so as to prevent damage to the motor, prevent jamming of the dispenser, and/or allow faster dispensing of sheet material.

Figure 10A:
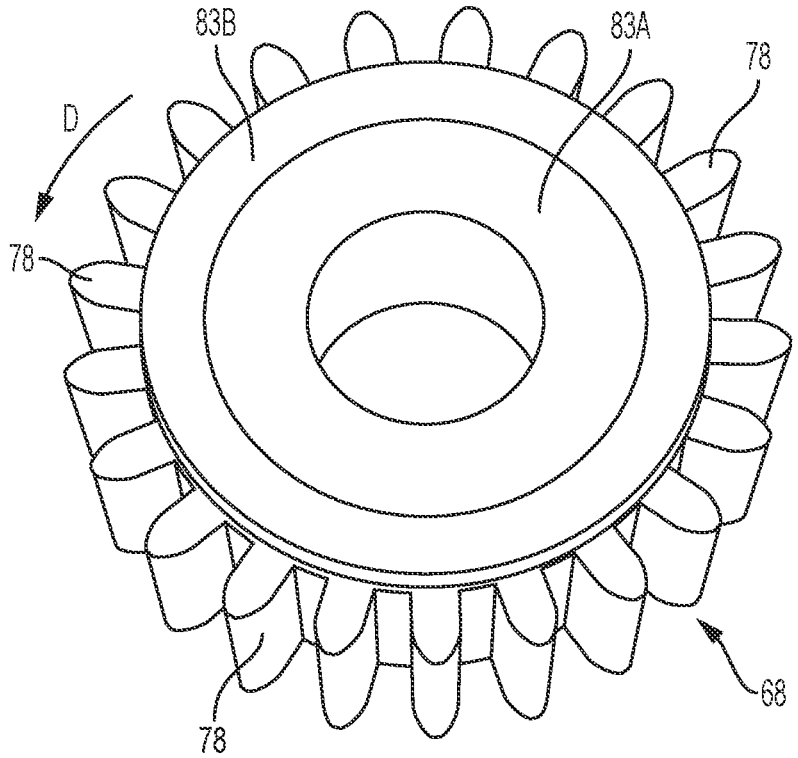
FIGS. 10A-10C show an example clutch assembly for the feed roller drive assembly according to principles of this disclosure.
Figure 10B:
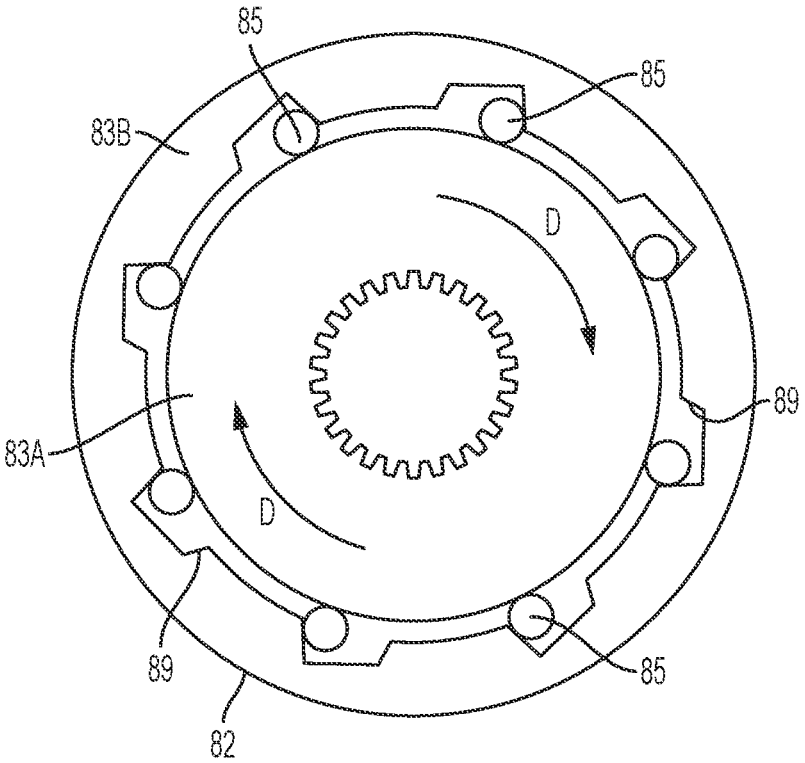
Figure 10C:
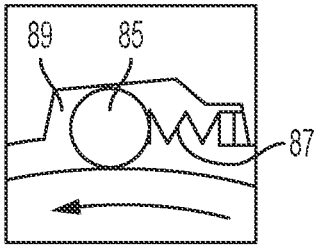

In particular, the gear drive arrangement/assembly 62 constructed or configured to act as the hybrid or one-way clutch assembly is configured or constructed such that the drive gear 68 or, alternatively, the roller gear 82 may include one or more tracks/races, such as inner and outer races 83A/B, that may rotate together or independently of one another (FIGS. 10A-B). The outer race 83B may include a series of biased rollers or bearings 85, such as by a series of springs 87, that engage/disengage with the corresponding notches or other engagement portions 89 of the outer race 83B to stop or prevent rotation of the rollers 85. As such, when the inner race 83A is rotated in the drive direction D, such as by operation of the motor 60, the rollers 85 are engaged thereby and urged into the notches 89 so as to prevent rotation of the rollers 85 and allow the inner race 83A to drive, and thus rotate, the outer race 83B to drive the feed roller 18. When the outer race 83B is rotated separately, such as by manual dispensing of the sheet material, the rollers 85 can be held in place by the springs 87 so as to rotate or spin freely, allowing the outer race 83B to turn substantially independently of the inner race 83A, and thus enable the feed roller 18 to rotate absent resistance caused by forced rotation of the motor 60.

Figure 5B:
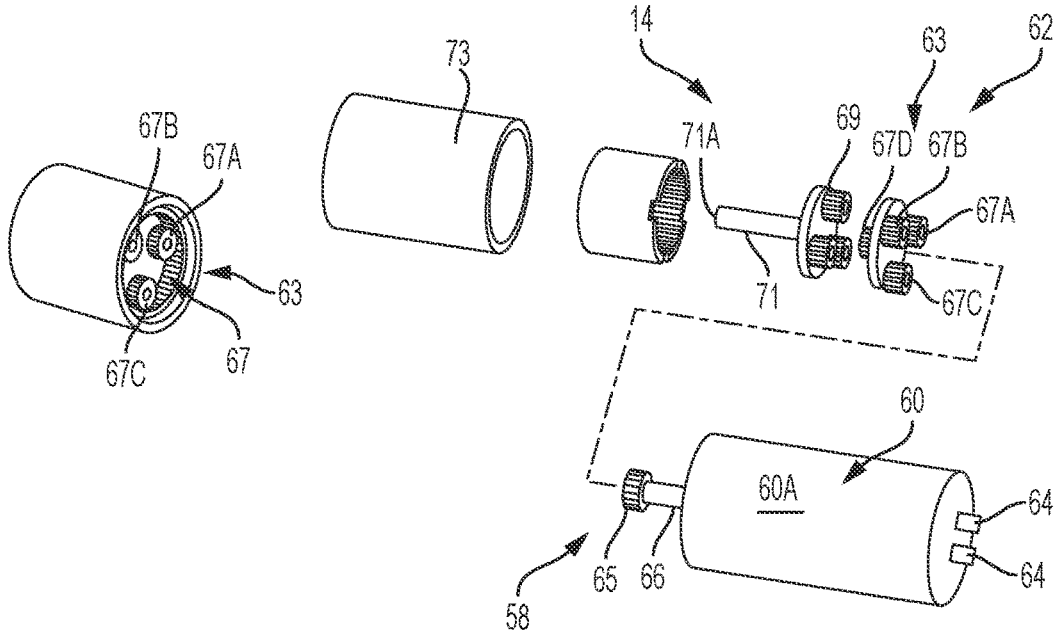
FIG. 5B is an exploded view of an example gear arrangement for the drive assembly of the feed roller drive assembly shown in FIG. 5A.

Other gear or drive arrangements also can be used. For example, as indicated in FIG. 5B, a planetary gear arrangement 67 of a gear reduction assembly 63 can be provided, wherein the drive motor 60, which can include a brushless servo motor, a stepper motor or other, similar type of adjustable, variable speed motor sized, configured to fit within the open end of the feed roller body, with driveshaft 66, further can be coupled to or include a drive gear 65 mounted thereon. This drive gear in turn can engage a corresponding planetary or other drive gear arrangement 67 of a gear reduction assembly 63. For example, the drive gear 65 of the driveshaft of the motor can engage a first planetary gear assembly 67, with the drive gear of the motor driveshaft being received between and engaged by a series of three-four planetary gears 67A-C which in turn can drive a forwardly extending gear 67D adapted to engage a second planetary gear assembly 69, the rotation of which in turn drives a fixed or stub shaft 71 as illustrated in FIG. 5B. The gear reduction assembly 63 also can be received within a gear reduction assembly housing 73 as a unit, with the stub shaft or planetary gear driveshaft 71 of the gear reduction assembly 63 being attached or mounted at its distal end 71A to a partition or otherwise engaging the inner side wall of the feed roller body. It also will be understood that fewer or more, or still other gear drive arrangements also can be provided as needed to adjust or reduce the driving force provided by the motor for driving the feed rollers.

The drive assembly 58 typically can be mounted substantially adjacent to the first or second end 28A/28B of the feed roller body 28, for example, in a substantially fixed position at one end, such as the first end 28A, of the feed roller body 28, with the drive assembly 58 being at least partially positioned, disposed or arranged within the interior cavity 32 so as to be integrated with the feed roller body 28. As schematically indicated in FIGS. 3 and 4A-B, the drive assembly 58 may include the motor housing 96 mated to the dispenser housing 16 for supporting or holding the motor 60 within the interior cavity 32 of the feed roller body 28. The motor housing 96 will generally include a body 98 with the base or flange portion 100 and a substantially cylindrical portion 102 extending or protruding from the base 100, which cylindrical portion 102 defines a cavity or chamber 104 extending therealong sized, configured and dimensioned for receiving or housing the motor 60. The motor 60 may be secured or fixed within the motor housing 96, such as by press fitting the motor 60 within the chamber 104, and there may further be one or more seals or other suitable elastic portion formed from a cushioning or dampening material and arranged or positioned between the housing 96 and the motor 60 sufficient to dampen or reduce vibrations caused by operation of the motor 60.

The flange portion 100 of the motor housing 96 also can have a series of holes or apertures 106 formed/defined therein so as to align with the holes 54 defined in the housing sidewall 38/39 and the apertures 52 of one of the bearing assemblies 40 so that the motor housing 96 can be fixed in place within the dispenser housing 16 by the fasteners 56, and further can extend into and be supported within the recess or cavity 32 of the roller body 18 providing an integrated driven roller assembly (FIG. 4A). The body 98 of the motor housing 96 further may include a stepped portion 99 with a surface 99A, which stepped portion 99 may be configured, sized and dimensioned to be fitted and received within one or more protruding portions or ridges 57 of the bearing assemblies 40 such that an inner surface 57A of each of the ridges 57 can contact or engage a surface 99A of the motor housing, so as to facilitate construction of the dispenser by, for example, ensuring proper alignment of the motor housing with respect to the sidewalls 38/39 and the feed roller body 28 thereby increasing the tolerances or the allowable deviation of the dimensions of the motor housing and reducing potential errors during manufacturing.

As illustrated in FIGS. 5A and 6B-C, the motor 60 also can be rotatably mounted and supported within the body of the feed roller, such as by one or more spaced motor/roller bearing assemblies 265. As indicated in FIG. 5A, the motor bearing assemblies 265 can include a series of ball or roller bearings contained between bands or sections 267, which bearings can be fixed to or integrally formed with an outer surface 60A of the motor 60. As a result, as the feed roller 18 is rotated, the motor can remain stationary with the feed roller body 28 being driven by operation of the motor 60 and rotating thereabout. Also, though two bearing assemblies 265 are shown in the present embodiment, one bearing assembly or multiple bearing assemblies can be used without departing from the present disclosure.

With the motor 60 at least partially disposed within the roller body 28, the noise generated/heard from operation of the motor 60 can be substantially reduced. A relatively large diameter roller also may be employed/selected to provide a housing or cavity for containing a desired size motor 60 within the roller body 28, as needed. For example, the roller body 28 may have a diameter in the range of approximately 20 mm to approximately 40 mm, such as about 24 mm or about 36 mm, and increasing the diameter of the roller body 28 can generally allow for the use of a bigger motor, which may increase efficiency and/or the power supplied to the feed roller 18 so as to allow for dispensing of heavier sheet materials. It further should be understood that additional drive system or assemblies also can be provided, e.g., on both sides or ends of the feed roller, as needed, such as for feeding heavier sheet materials.

FIGS. 3 and 4A further show a sealing member or cover 108 that can be placed over the drive assembly 58 and the corresponding bearing assembly 40 to substantially seal off the components of the drive assembly 58 received within the roller body 28 and the corresponding bearing assembly 40 attached to the dispenser housing 16 so as to prevent particulates or other particles from impacting performance of the motor 60, operation of the other components of the drive assembly 58, and/or rotation of the bearing assemblies 40 or feed roller 18. The sealing cover 108 can include a body 110 with a cavity or chamber 112 defined therein and having an inner rear wall 114 and inner sidewalls 116. The chamber 112 can be sized, dimensioned and configured to cover the flange 100 of the motor housing body 98 and/or the flange 50 of the bearing assemblies 40. The sealing cover 108 may be releasably or detachably connected or coupled to the flanges 50/100 to allow for replacement and/or maintenance of the various components of the dispenser 10. However, the sealing cover 108 may be more permanently connected to the dispenser housing 16 and/or flanges 50/100, such as by an adhesive or other suitable means, so to, by way of example, prevent tampering with the components housed therein.

Figure 12B:
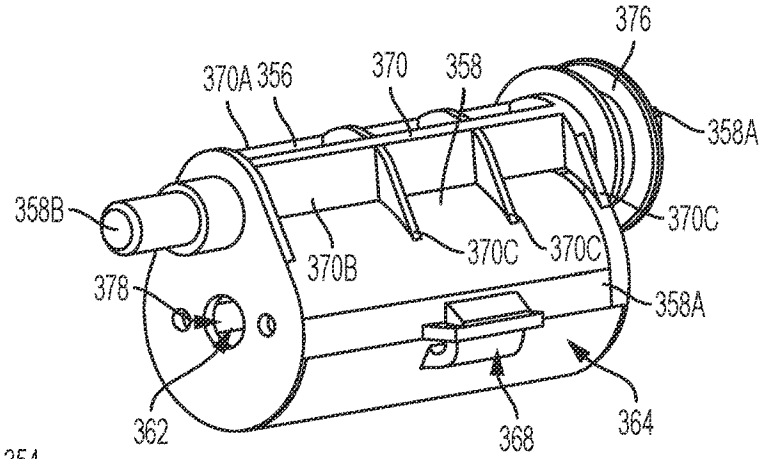
FIG. 12B shows a drive system housing for the integrated feed roller drive assembly shown in FIG. 12A.
Figure 12A:
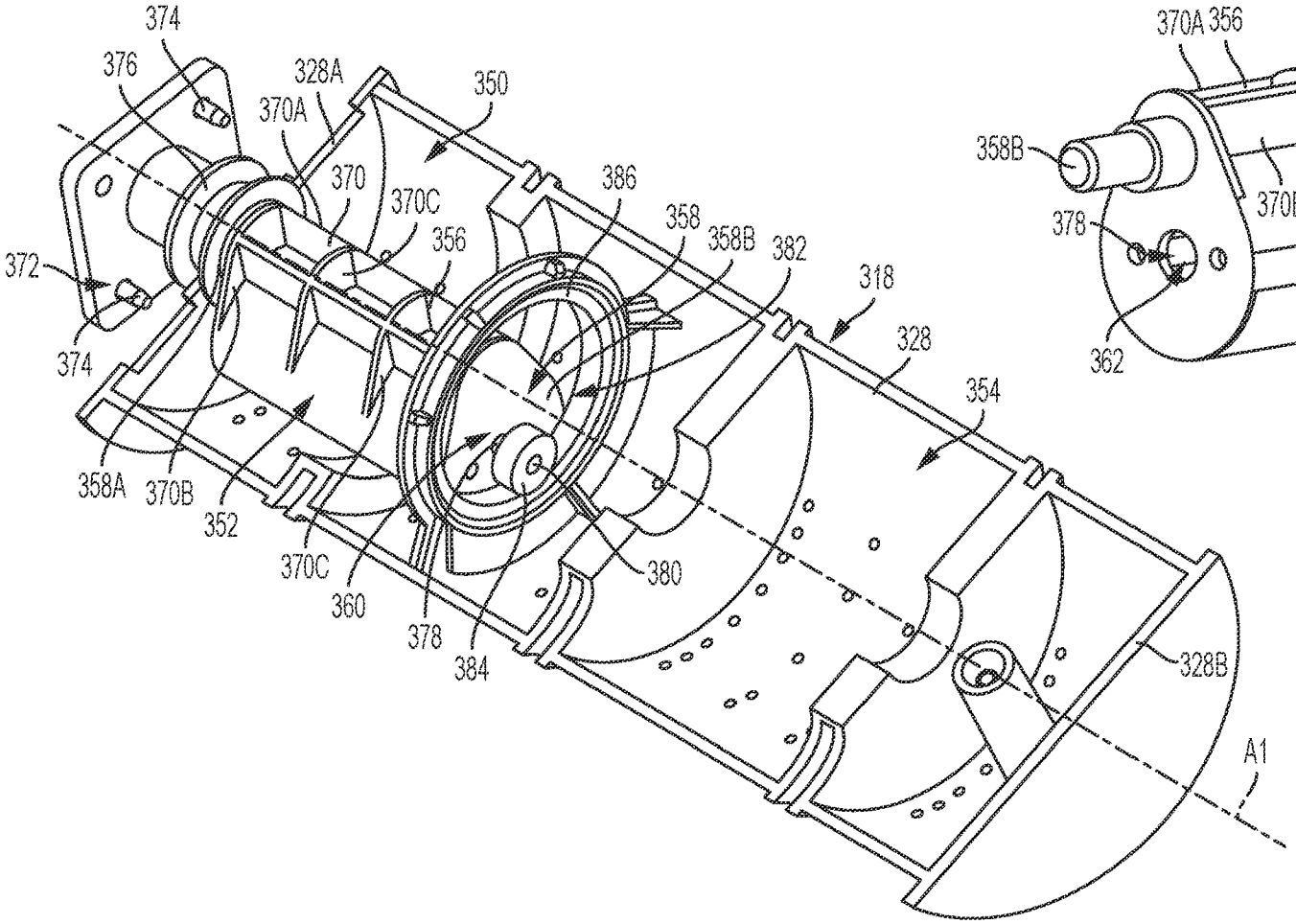
FIG. 12A shows an additional example of an integrated feed roller drive assembly according to one aspect of the present disclosure.

FIGS. 12A-B further show an alternative feed roller drive assembly 14 with a drive system 350 that is substantially received or located within a chamber or cavity 354 defined/enclosed by a body 328 of a feed roller 318. The feed roller drive system 350 can be mounted near or adjacent one of the ends 328A/B of the feed roller body 328, and generally can include a motor housing 356 that at least partially houses or supports a drive motor 360 for driving rotation of the feed roller 318 to feed a selected or desired amount or length of sheet material. The motor 360 may include a servo or stepper motor or other, similar type of adjustable, variable speed electric motor, and can have a series of leads or connectors, such as a plug-in type connector or other similar connection mechanisms, through which the motor 360 can communicate with, and receive instructions and power from, the control system 200 and a power supply or source of the dispenser.

As indicated in FIG. 12A, the motor housing 356 generally includes a body 358 that can have an eccentric or offset configuration and which includes or at least partially encloses a cavity or chamber 362 sized, dimensioned, or otherwise configured to receive the motor 360 (FIG. 12B). The motor housing 356 also can have a movable cover or removable portion or section 364 along an outer surface 358A of body 358 of the motor housing 356, so that the motor 360 can be removed/replaced, or otherwise accessed within the chamber 362 of the motor housing 356 (FIG. 12B). The cover removable portion 364 also can be closed and secured or locked into place, such as by a connector or other locking mechanism 368 arranged along the outer surface 358A of the body 358 of the motor housing 356 to encase or enclose the motor 360 therein and prevent the motor 360 from exposure to moisture, dust, or other particulates. This connector/locking mechanism 368 may include, for example, a snap fit connection, hook and groove locking mechanism, or other suitable connection or locking structure/configuration.

In one embodiment, the motor housing 356 additionally can include an elongated support portion 370 arranged/extending along the outer surface 358A of the motor housing body 358. The support portion 370 may include supports or arms 370A/B with a series of flanges 370C disposed thereabout, which supports 370A/B and/or flanges 370C can be integrally formed with, or otherwise coupled to, the motor housing body 358 so as to support the motor housing 356, with the motor 360 received therein, within the body 328 of the feed roller 318 such as illustrated in FIG. 12A. This support portion 370 can further extend or protrude from and be connected to/supported by a base or bearing portion 372 that is coupled to the interior of the sidewall of the dispenser housing 302, such as by fasteners 374, e.g., bolts, screws, rivets, or other suitable fasteners. The base/bearing portion 372 alternatively can be integrally formed with one of the sidewalls 304/306, or other portion, of the dispenser housing 302. The support portion 370 for the motor housing also can include a bushing or bearing 376, arranged adjacent or near one of the ends 358A (or 358B) of the body 358 of the motor housing 356. The bushing or bearing 376 can rotatably support the feed roller 318 at one of its ends, e.g., 328A, such that the feed roller 318 can be rotated/driven under the power of the motor 360 so as to dispense the selected amount or length of sheet material 12, as well as actuate the cutting blade 322 to at least partially cut or perforate the sheet material 12 as it is dispensed.

The body 358 of the motor housing 356 can additionally include an aperture or opening 378 defined therein, through which a driveshaft 380 of the motor 360 can protrude or extend (FIG. 12A). As further shown in FIG. 12A, the motor housing 356 can be positioned/arranged within the feed roller body 328 such that the driveshaft 380 of the motor 360 is offset or in a spaced relationship with respect to a longitudinal central axis A1 of the feed roller body 328. The driveshaft 380 further can be operatively connected to a gear assembly 382 to drive or transfer torque or power between the motor 360 and the feed roller 318. For example, the gear assembly 382 can include a ring or orbital-type gear assembly with a drive gear 384, such as a spur or similar type gear, connected to the driveshaft 380 of the motor 360 and is configured to engage a ring or hoop gear 386 connected to or integrally formed with, the feed roller body 328 for transfer of torque/power between the motor 360 and the feed roller 318 and cause rotation thereof. The offset of the driveshaft 380 and gear assembly 382 can allow for additional changes in the diameter of the feed roller, reducing or otherwise varying the size of the motor, and/or increased flexibility in the operation/driving of the feed roller for dispensing or feeding a variety of different type and/or weight sheet materials. In addition, the engagement of drive gear 384 and hoop gear 382 may be configured so as to act as a hybrid clutch assembly that enables the feed roller 318 to be selectively driven by the motor 360, and also allows the feed roller 318 to rotate independently of the motor 360, for example, when a user pulls the sheet material, such as for manual dispensing thereof, and/or if the motor 360 is experiencing a low power condition or is powered off. In addition, the an involute spline gear assembly, such as shown in FIGS. 4A-B, or a planetary gear arrangement, such as shown in FIGS. 5A-B, also may be used with the feed roller 318 without departing from this disclosure.

As indicated in FIGS. 2C, 11, 13 and 15-19, the dispenser additionally may include one or more cutting mechanisms 120/320 to allow for at least partially cutting, perforating, or otherwise creating a line of separation, at or along a selected portion of the sheet material 12 after a desired or prescribed length of the sheet material has been dispensed or fed. For example, as generally shown in FIGS. 13 and 15-19, one example cutting mechanism 120/320 can include an actuating or movable cutting blade 122/322 having a series of teeth 124/324 may be at least partially received within the feed roller body 28/328 and can be selectively movable to cut or make a series of perforations in the sheet material 12 to enable/facilitate tearing or removal thereof.

Figure 13:
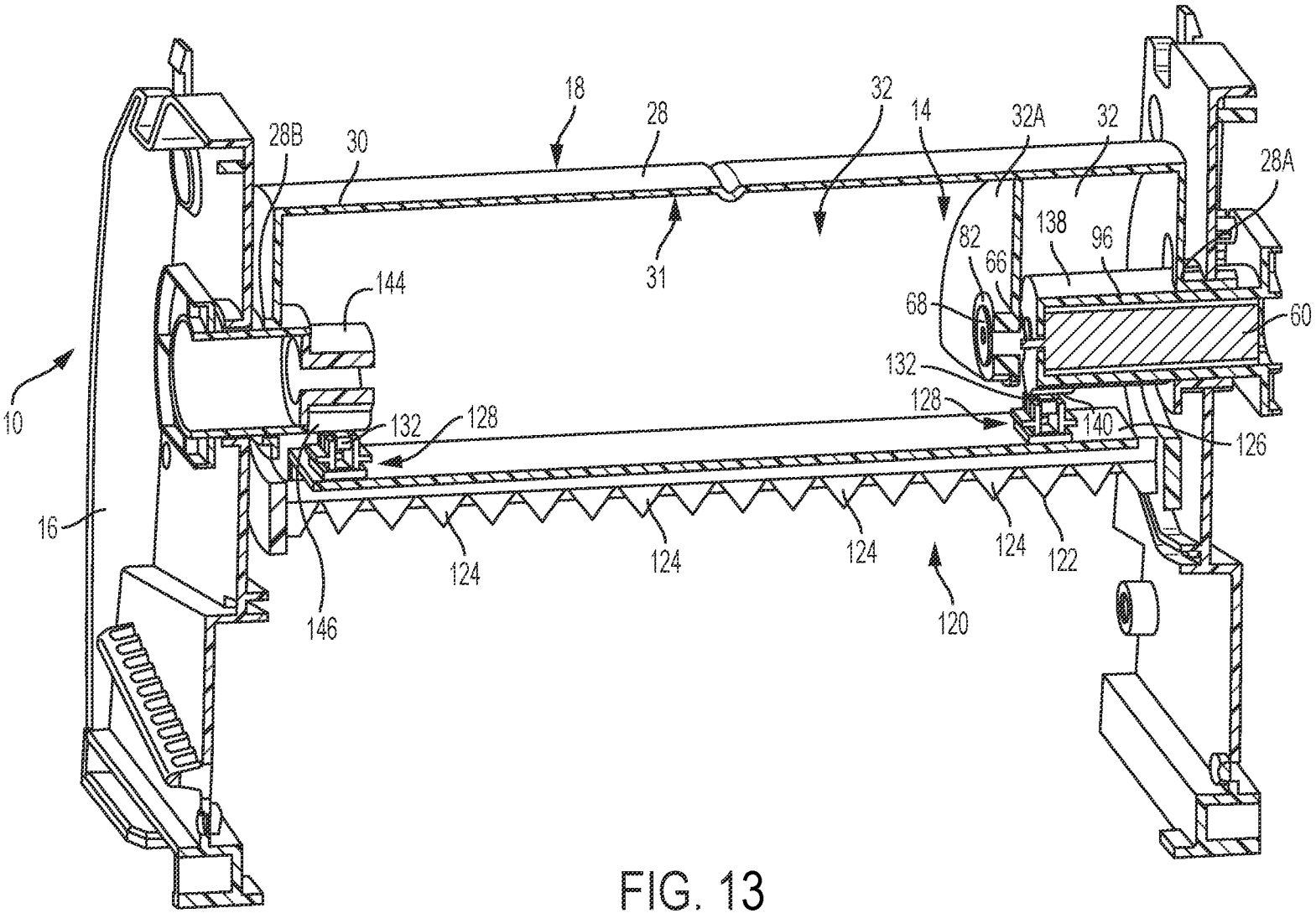
FIG. 13 shows a cross-sectional, partial cutaway view of a cutting mechanism for use with a dispenser according to principles of this disclosure.
Figure 15:
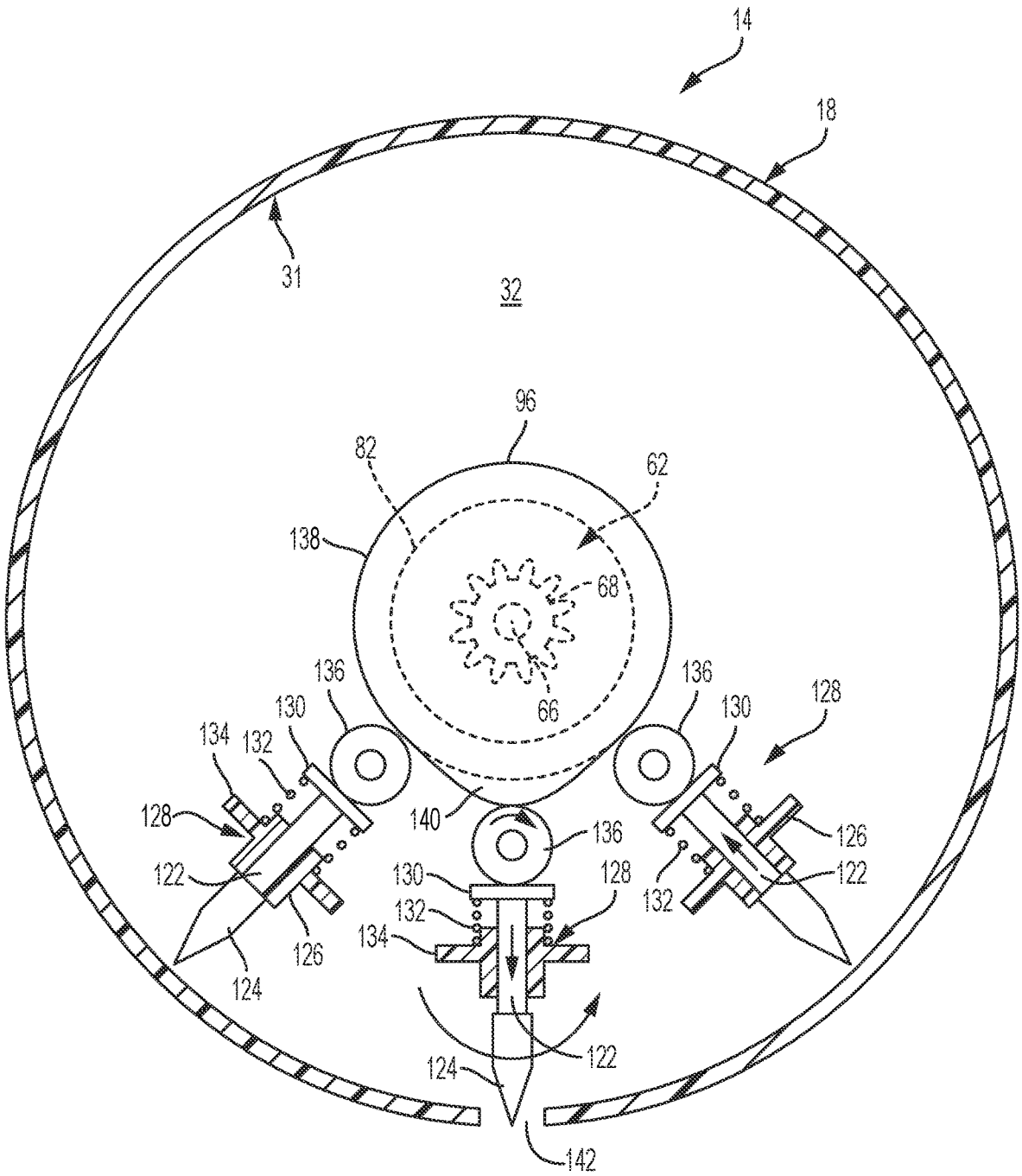
FIG. 15 provides a cross-sectional view of the cutting mechanism according to FIG. 13.

In one embodiment, as illustrated in FIGS. 13 and 15, the cutting blade may be at least partially supported by a support portion or body 126 that can be substantially fixedly connected within the feed roller body 28 so that the cutting blade 122 is rotatable therewith. As shown in FIG. 15, the cutting blade 122 may further be actuated between a series of positions, including a first position retracted within the feed roller, and a second or further additional positions extending or projecting out of the roller body 28 at a selected point during rotation of the feed roller and/or at a selected location along the feed path of the sheet material, under the control of one or more piston-like actuation mechanisms 128. Upon such extension, the cutting blade can cut or perforate the sheet material after the feeding/dispensing of a desired or prescribed amount or length of material has been drawn from the supply to dispense a measured (i.e. a 12", 10" or other length) sheet. In some embodiments, each actuation mechanism 128 generally can include a movable body 130 supporting the cutting blade 122, an elastic body, such as a spring 132, that biases the cutting blade 122 toward its retracted position and is compressible between the movable body 130 and one or more flanges 134 of the support body 126 for controlling the movement of the movable body 130 and cutting blade 122 coupled thereto. The movable body 130 may further be operatively connected to a roller or cam follower (or followers) 136 that move about a guide surface 138 of the motor housing 96 and can engage with a cam surface 140 (FIGS. 13-15) arranged therealong so as to move the movable body 130 and the cutting blade to its extended cutting position.

For example, shown schematically in FIG. 15, as the feed roller 18 is driven by its motor, or is manually rotated, the rollers 136 may roll along the guide surface 138 of the motor housing 96, with the cutting blade 122 held in a retracted position by the springs 132. As the roller 136 contacts or engages the cam surface 140 to compress the springs 132 and thereby cause the cutting blade 122 to move to an extended positon with the teeth 124 of the cutting blade extending/projecting out of slots or series of openings 142 defined in the feed roller body 28 so as to at least partially cut or perforate the sheet material 12 to enable or facilitate its removal. The cam 140 may be positioned on or arranged along the body 98 of motor housing 96 (FIG. 14) so that the cutting blade 122 (FIGS. 13 and 15) is in the extended position and thereby cuts or perforates the sheet material at, adjacent to, or substantially near a pressing roller, such as at a pinch point between the feed roller and a pressing roller, though the sheet material 12 can be alternatively cut or perforated at any suitable position. After the roller 136 (FIG. 15) moves away from engagement with the cam surface 140, and moves along/engages the guide surface 138, the cutting blade 122 may return to a retracted position. Further, there may be corresponding guide and cam surfaces 144/146 along a side of the feed roller 18 opposite the motor housing so as to enable/facilitate substantially consistent extension of the cutting blade 122 along the feed roller 18.

Figure 16A:
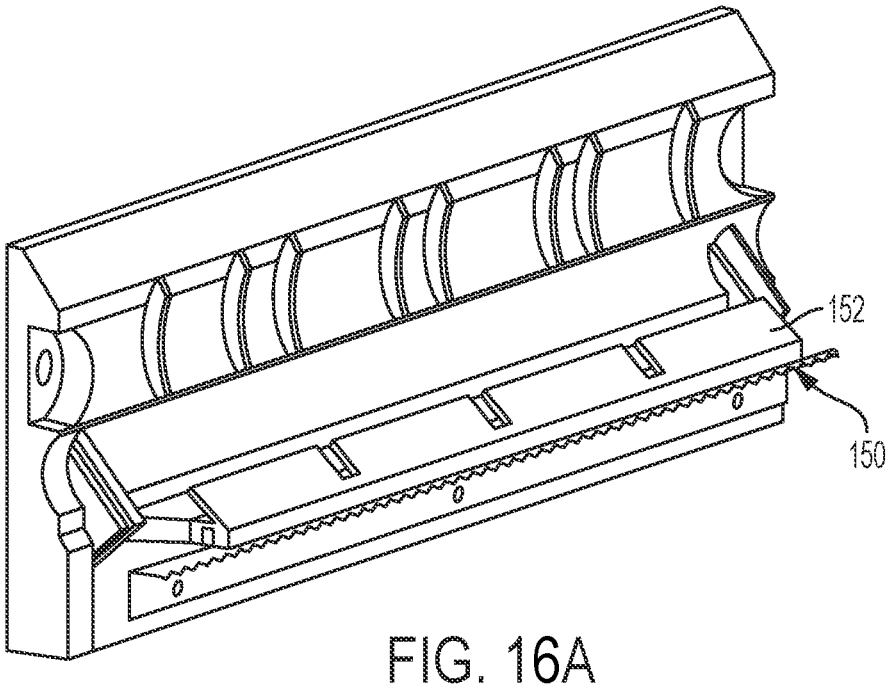
FIGS. 16A-16B provide examples of a tear bar and pivotable pawl member according to principles of this disclosure.
Figure 16B:
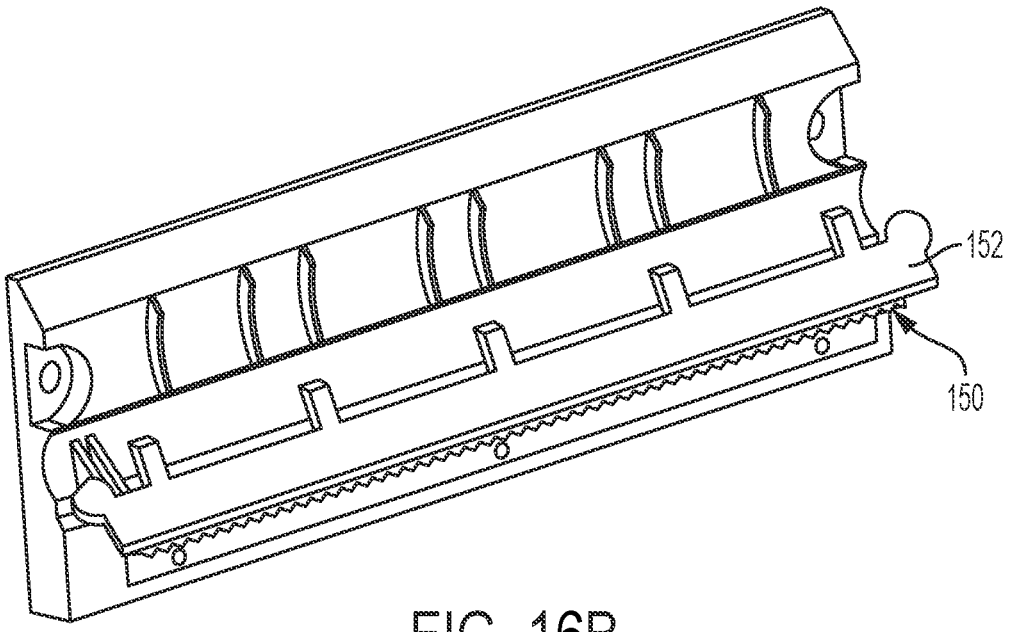

Additionally, or alternatively, the dispenser housing 16 may include one or more tear bars or other suitable cutting members 150 disposed adjacent or along the discharge throat or chute of the dispenser housing so that a user can separate a sheet or measured amount of the material by grasping and pulling the sheet across the tear bar 150 (FIGS. 2C and 16-16B). In addition, a pivotally mounted pawl member 152 can be located proximate to the stationary tear bar 150 such that movement of sheet material 12 into the tear bar 150 for severance pivots the pawl member 152 between multiple positions, e.g. a first 152 A and second 152 B positions. A signal device such as a proximity sensor switch or the like, cooperative with the pawl member 152, can also be arranged such that movement of the pawl member 152 between various positions causes the signal means to send a signal to notify the control circuit that the sheet material has been removed. By way of example, as shown in FIG. 2C, such signal means responsive or cooperative with the pawl member 152 can include an infrared emitter 151 and detector 153 that detects movement of the pawl member 152 between the first and second positions 152A/B, though any suitable sensor can be employed such as a proximity sensor or other detector, a magnetic switch, or a mechanical switch. After receiving a signal that sheet material 12 may have been removed, the control circuit can activate a paper detection sensor to verify that the sheet material has been removed from the discharge chute.

Figure 17A:
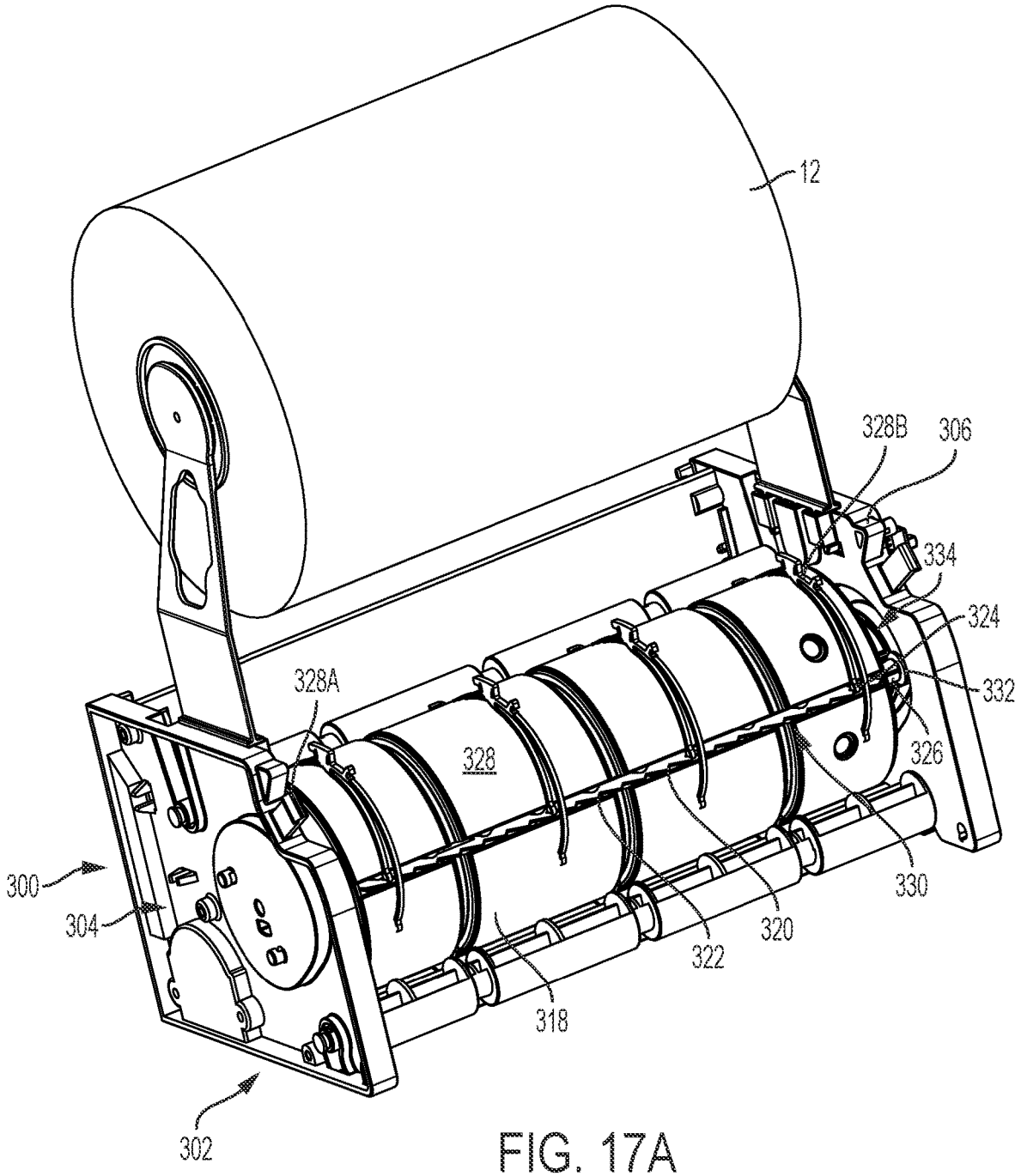
FIGS. 17A-17B show perspective and top views of an example dispenser including a cutting mechanism according to principles of the present disclosure.
Figure 17B:
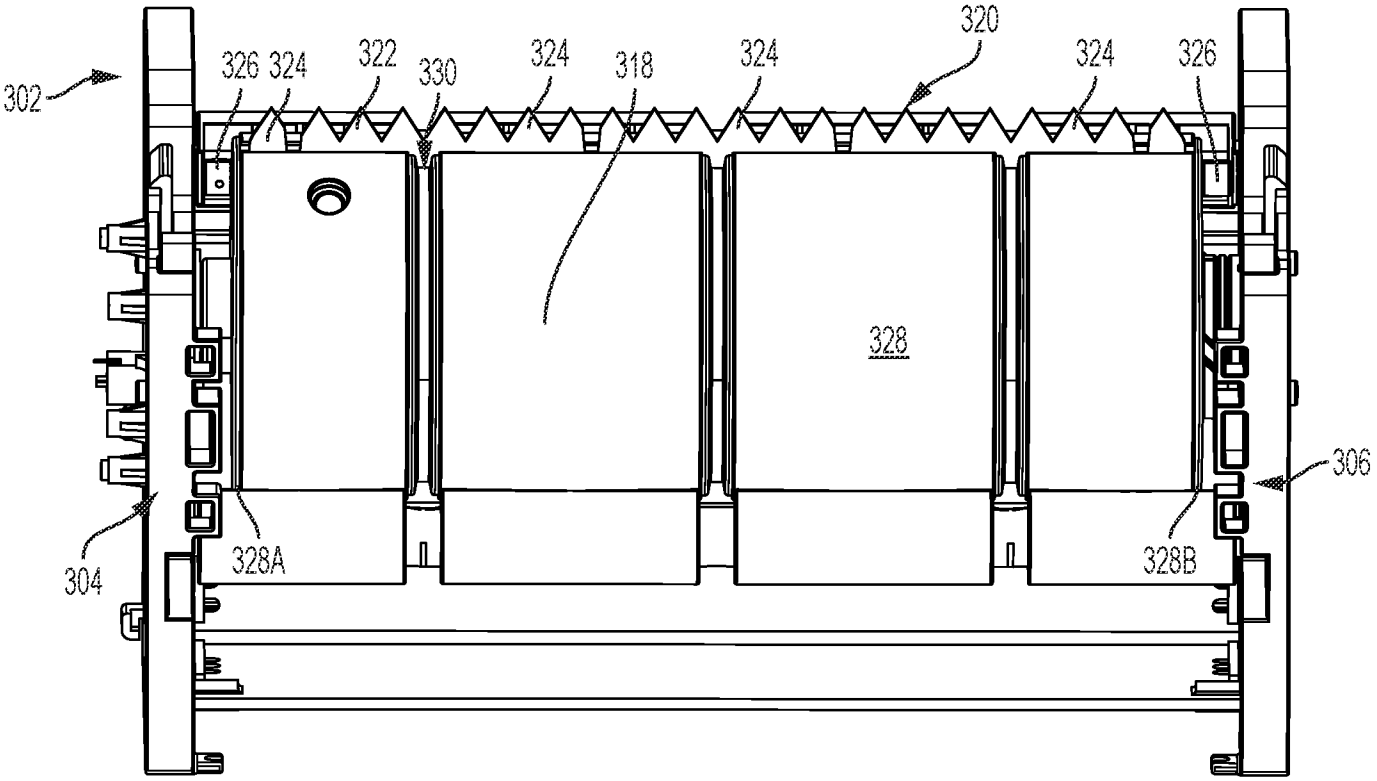
Figure 17C:
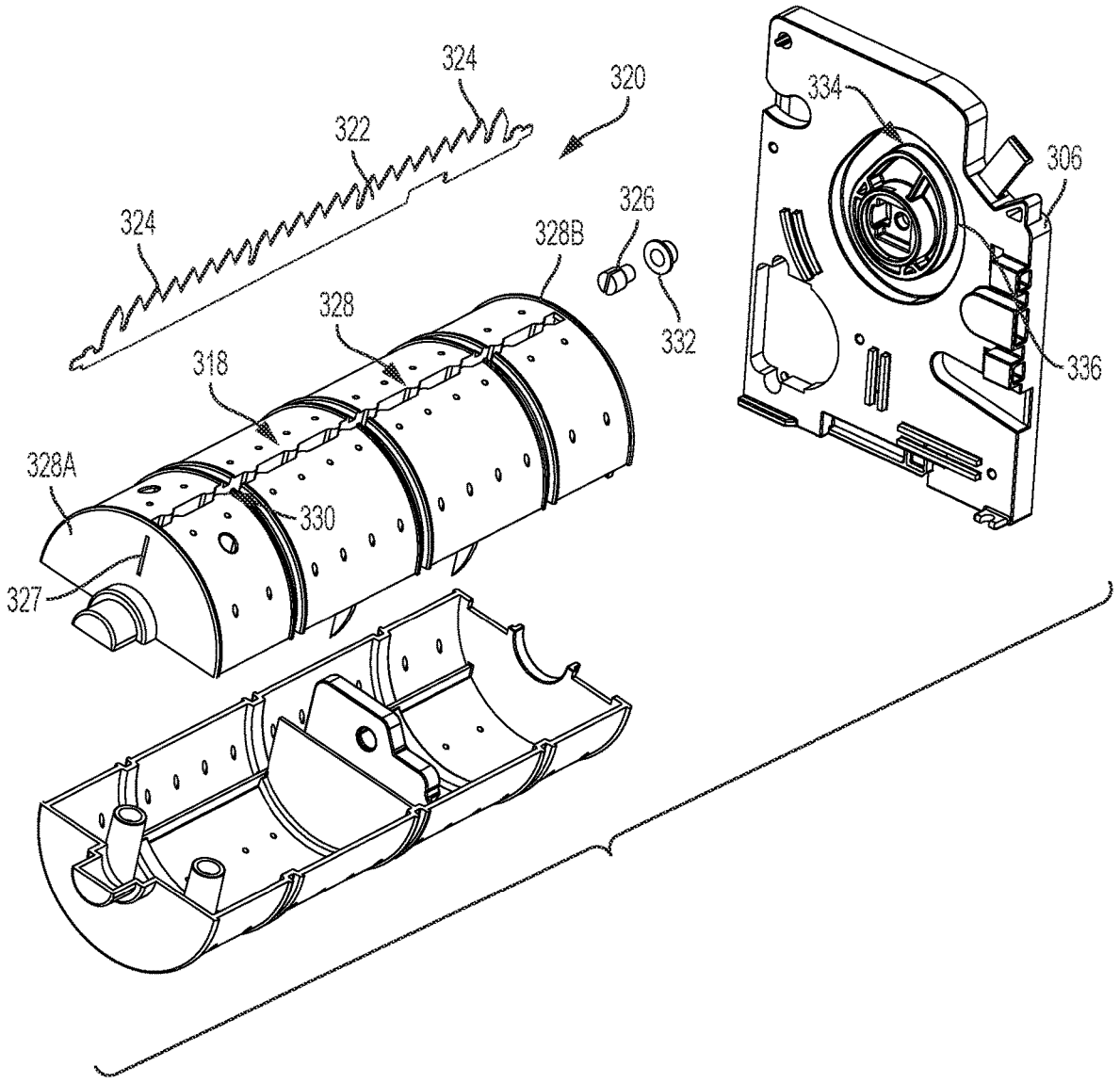
FIG. 17C shows an exploded view of the cutting mechanism according to FIGS. 17A-17B.

FIGS. 17A-C show a further example dispenser 300 with a cutting mechanism 320 that is disposed or positioned within a rotatable feed roller 318 mounted within the dispenser housing 302. The cutting mechanism 320 can be configured to move or be actuated at a prescribed or preset point during a revolution of the feed roller, or after a prescribed rotation of the feed roller so as to selectively cut or perforate the sheet material after a desired or prescribed length or portion of the sheet material has been fed or dispensed. For example, the cutting mechanism 320 may be supported within the body 328 of the feed roller 318 and can be at least partially extensible/retractable into and out of the body 328 of the feed roller through an opening, aperture, or slot 330 defined therein as indicated in FIGS. 17A-B, with the rotation of the feed roller 318 to selectively cut or perforate the prescribed length or amount of sheet material 12 after it has been pulled or fed from the supply roll for dispensing.

The cutting mechanism 320 can include a cutting blade 322 (FIG. 17C) with a cutting edge or series of teeth 324 formed/arranged therealong, and which blade 322 can be movably supported or otherwise coupled to the feed roller body 328, such as by a connection member or support 326 at or adjacent one or both ends 328A/B of the feed roller body 328. The connection member(s) 326 further can slide or move along, e.g., in a substantially linear direction, a slot or groove 327 defined in one or more of the ends 328A/B of the feed roller body 328 to cause the cutting blade to be extended and retracted. The cutting blade 322 also may be rotatably or pivotably connected to the feed roller body 328 so as to be movable in and out of opening 330 without departing from this disclosure.

Additionally, as generally shown in FIG. 17C, the support portion 326 (or support portions 326 if provided along both ends of the feed roller) can have a cam follower 332 disposed at an end thereof, which cam follower 332 can ride or slide within a cam track 334 defined along one or more of the side walls 304/306, or other portions, of the dispenser housing 302. The cam track 304 will be formed with a series of guide or contact surface(s) 336 along which the cam follower 332 is moved as the feed roller 318 is rotated for dispensing or guiding the sheet material 12, e.g., when a user manually rotates the feed roller 318 or pulls a portion of the sheet material 12, or when the feed roller 318 is driven by a drive mechanism (e.g., a motor) to automatically dispense a selected amount or length of the sheet material 12. Thus, as the feed roller 318 is rotated and the cam follower 332 moves along contact surface 336, support portion 326 connected to the blade 322 is moved along its guide slot or groove 327, in turn causing the blade 322 to move from a first or initial position, housed within the body 328 of the feed roller to a second operative or engaging position, in which the blade 322 at least partially extends out of the opening or slot 330 to engage, cut and/or perforate the sheet material 12. For example, the cutting blade can be actuated/extended at a selected or desired point during rotation of the feed roller (which can be of a diameter/circumference selected to feed a prescribed length or amount of sheet material per revolution), or following more than one rotation/revolution of the feed roller. As the cam follower 332 continues to move along the cam track 334 with the rotation of the feed roller, the blade 322 can be returned to its initial position such that the teeth 324 are retracted into the body of the feed roller and/or do not otherwise project or extend from the opening 330 defined along the feed roller body 328 sufficient to engage the sheet material.

The feed roller 318 also can be manually driven if needed, e.g., when a user pulls on a portion of the sheet material 12 for dispensing thereof, or can be automatically/electrically driven by a driven feed roller assembly (FIGS. 12A-B, 18A-B, and 19). For example, for a manually driven feed roller, the feed roller assembly further can include a series of biased members, e.g., springs, that can cause rotation or movement of the feed roller 318, such as by a desired or set amount of rotation thereof, after a user manually dispenses the sheet material 12 so as to reset the cutting blade 322. For example, when a user pulls on the sheet material 12 or otherwise rotates the feed roller 318 for dispensing the sheet material, the cutting blade 322 can be moved out of the opening 330 and into the operative position for at least partially cutting or perforating a portion of the sheet material 12 to facilitate removal thereof, and after the portion of sheet material 12 is removed and the user no longer acts to rotate or move the feed roller 318, the biasing members, e.g., springs, can be arranged and connected to the feed roller 318 to cause the feed roller 318 to continue to rotate to a position in which the cutting blade 322 is returned to its initial position within the body 328 of the feed roller.

Figure 18A:
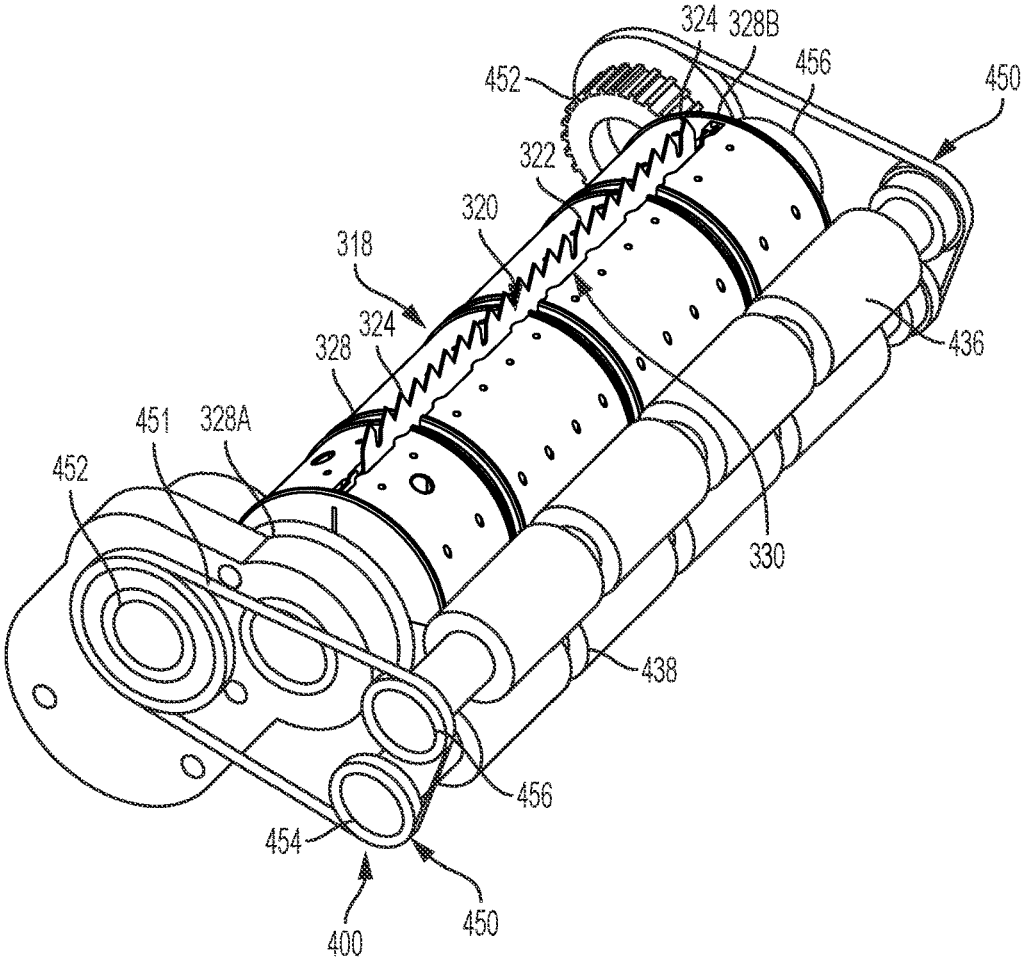
FIG. 18A shows a perspective view of an external drive assembly including a gear transmission assembly according to principles of the present disclosure.
Figure 18B:
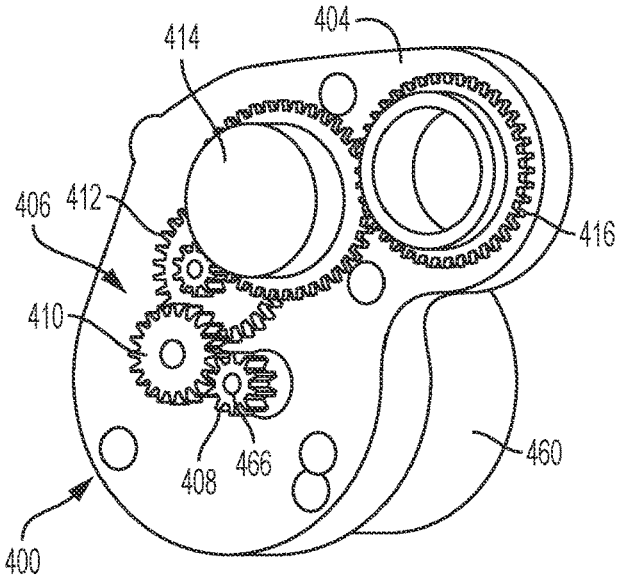
FIG. 18B shows an exploded view of the external drive assembly including the gear transmission assembly according to FIG. 18A.
Figure 19:
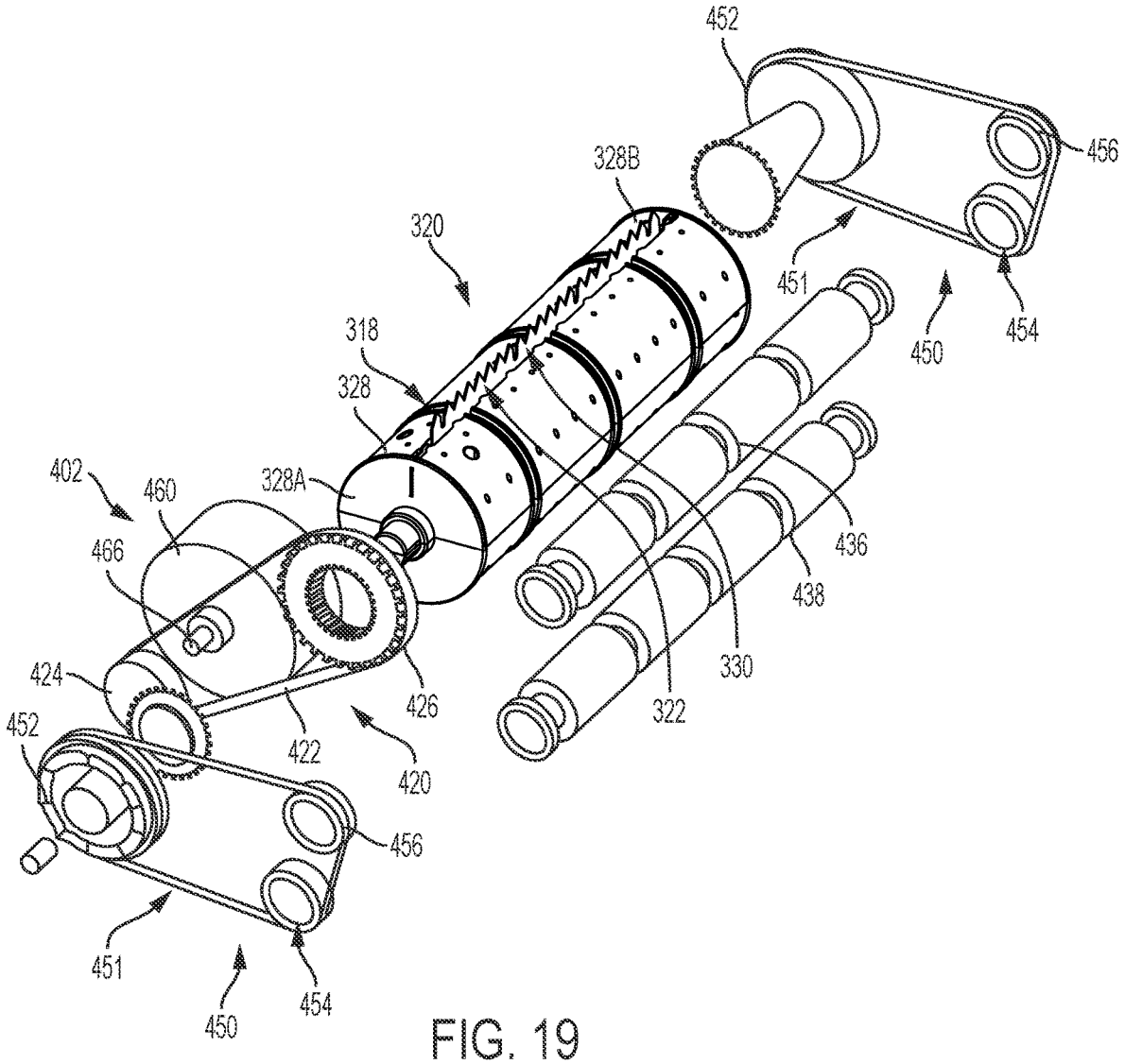
FIG. 19 shows a perspective view of a drive assembly including a belt drive transmission assembly according to principles of the present disclosure.

In addition to internally driven feed roller assemblies, such as shown in FIGS. 3-7B and 12A-C, FIGS. 18A-B, and 19 show other example driven feed roller assemblies for automatically dispensing and cutting or perforating a selected portion of the sheet material according to principles of the present disclosure. FIGS. 18A-B and 19 show example external drive assemblies/systems 400, 402 that can be located/arranged separate from the feed roller 318 within the housing 302, including a motor 460, e.g., a brushless servo, a stepper motor or a DC motor, positioned or disposed in spaced relationship with respect to a feed roller body 328. The motor 460 can further be operatively connected to a gear transmission arrangement or assembly 406 (FIG. 18B) that transfers torque or power from the motor 460 to the feed roller 318 so as to rotate the feed roller 318 and dispense a predetermined or selected amount of sheet material 12, while also controlling actuation of the cutting blade 322 to move into and out of the feed roller 318 to cut or perforate the sheet material 12 as it is dispensed.

The gear assembly 406 can include a series of gears 408-416, each having a plurality of teeth engaging or otherwise interacting with corresponding teeth of an adjacent gear, including a gear 408, fixed or otherwise connected to the driveshaft 466 of the motor 460, and which operatively engages and drives a gear 416 fixed or otherwise connected one of the ends 328A/B of the feed roller body 328, e.g., through a series of intermediate gears 410, 412, 414. Although the series of gears 408-416 is shown as including five circular mesh gears connected in series, any number, type or arrangement of gears or other suitable gear reducer can be employed without departing from the present disclosure. The gears 408-416 may be rotatably mounted to the support 404, such as by a hub or bearing assembly, though the gears may be mounted or arranged within the housing in any suitable manner.

The drive assembly 400/402 also may include a belt drive assembly 450 transferring torque/power between the motor 460 and pressing rollers 436, 438, which drive belt assembly 450 may comprise a belt 451 that engages a belt gear, sheave, or pulley 452, for example, which can be operatively connected to one of the intermediate gears 410-414, and sheaves or pulleys 454, 456 connected or fixed an end of the pressing rollers 438, 436, as shown in FIG. 18A. A belt drive assembly 450 also may be provided on the opposite ends of the feed roller 318, with the belt gear 452 engaging and being driven by a gear 456 operatively coupled to the feed roller body 328; however, only one belt drive assembly for driving the pressing rollers may be used without departing from the present disclosure.

Alternatively, as illustrated in FIG. 19, the gear transmission assembly 406 of FIGS. 18A-B can be replaced with a synchronous belt transmission 420 including, for example, a drive belt 422 engaging a sheave, pulley or belt gear 424 attached or operatively coupled to a driveshaft 466 of the motor 460 and a pulley or sheave 426 attached to an end of the feed roller 318. The belt transmission 420 of FIG. 19 may operate with reduced friction due to the elimination of the gears and also may result in a substantially reduced noise signature, as well as require less power for operation. The drive mechanism of FIG. 19 further can include an additional drive belt arrangement 450 for driving the pressing rollers 438, 436, including a drive belt 451 that engages a belt gear, sheave or pulley 452 connected to the drive shaft of the motor and also extends about and operatively drives belt pulleys or sheaves 454/456 connected to the pressing rollers 436, 438 to transfer torque from the motor 460 therebetween.

In addition, the drive belt mechanism 450 shown in FIGS. 18A-B and 19 further can include additional pulleys, sheaves, gears, etc., arranged/positioned adjacent the belt gear and engaging the drive belt, which pulleys may be biased or urged in a predetermined direction (e.g., away from the pressing rollers as indicated by arrows) by a biasing member, such as one or more springs, to provide a biasing force against, or to otherwise substantially maintain tension along, the drive belt 451 such that the pressing rollers 436, 438 are pulled or urged toward and are substantially maintained against and in contact with the feed roller, and/or so that the drive belts 451 are sufficiently tensioned to help avoid slippage thereof.

FIG. 20 illustrates a block diagram of an electronic control system or circuit 200 for operating the dispenser 10 in an exemplary embodiment. The dispenser or operative components of the dispenser may be powered by a power supply 154 such as one or more batteries 61 contained in a battery compartment, though any suitable battery storage device may be used for this purpose. Alternatively, or in addition to battery power, the dispenser may also be powered by a building's alternating current (AC) distribution system as indicated at 156. For this purpose, a plug-in modular transformer/adapter could be provided with the dispenser, which connects to a terminal or power jack port located, for example, in the bottom edge of the circuit housing for delivering power to the control circuitry and associated components. The control circuit also may include a mechanical or electrical switch that can isolate the battery circuit upon connecting the AC adapter in order to protect and preserve the batteries.

In one example embodiment of an electronic dispenser, the sensor 26, such as a proximity detector or other sensor, may be configured to detect an object placed in a detection zone external to the dispenser to initiate operation of the dispenser. This sensor may be a passive sensor that detects changes in ambient conditions, such as ambient light, capacitance changes caused by an object in a detection zone, and so forth. In an alternate embodiment, the sensor 26 may be an active device and include an active transmitter and associated receiver, such as one or more infrared (IR) transmitters and an IR receiver. The transmitter transmits an active signal in a transmission cone corresponding to the detection zone, and the receiver detects a threshold amount of the active signal reflected from an object placed into the detection zone. The control system circuitry generally will be configured to be responsive to the sensor for initiating a dispense cycle upon a valid detection signal from the receiver. For example, the proximity sensor 26 or other detector can be used to detect both the presence of a user's hand below. The dispenser can additionally include a paper detector sensor 158, such as one or more infrared emitters and infrared detectors with one infrared emitter/detector pair aligned to detect a user's hand below the dispenser 10 and the second infrared emitter/detector pair aligned to detect a sheet hanging below the outermost front edge of the discharge chute 22.

The dispenser control system or circuitry 24 can control activation of the dispensing mechanism upon valid detection of a user's hand for dispensing a measured length of the sheet material 12. In one embodiment, the control circuit can track the running time of the drive motor 60 of the motorized feed roller, and/or receive feedback information directly therefrom indicative of a number of revolutions of the feed roller and correspondingly, an amount of the sheet material feed thereby. In addition, or as a further alternative, sensors and associated circuitry may be provided for this purpose. Various types of sensors can include IR, radio frequency (RF), capacitive or other suitable sensors, and any one or a combination of such sensing systems can be used. The control system 24 also can control the length of sheet material dispensed. Any number of optical or mechanical devices may be used in this regard, such as, for example, an optical encoder may be used to count the revolutions of the drive or feed roller, with this count being used by the control circuitry to meter the desired length of the sheet material to be dispensed.

As also shown in FIG. 20, the processing logic for operation of the electronic dispenser in, for example, the hand sensor and butler modes, can be part of the control software stored in the memory of the microprocessor in the control system 24. One or more binary flags are also stored in memory and represent an operational state of the dispenser (e.g., "paper cut" set or cleared). An operational mode switch in the dispenser sets the mode of operation. In the hand sensor mode, the proximity (hand) sensor 26 detects the presence of a user's hand below the dispenser and in response, the motor 60 is operated to dispense a measured amount of sheet material 12. The control circuit can then monitor when the sheet of material is removed. For example, actuation of the pawl member 152 or triggering/activation of a paper detection sensor 158 can determine the removal of paper and reset the hand sensor. The hand sensor 26 also can be controlled to not allow additional sheet material to be dispensed until the hand sensor is reset. If the hand sensor 26 detects the presence of a user's hand but does not dispense sheet material, the control circuit can check for sheet material using the paper detection sensor 158. If sheet material 12 has not been dispensed (i.e., no sheet material is hanging from the dispenser), the motor 60 will be activated to dispense a next sheet.

A multi-position switch 160 also can be provided to switch the dispenser operation between a first or standard operation mode and a second mode, such as a butler mode. In such butler mode, the hand sensor 26 for detecting the presence of a user's hand can be deactivated, and the controller 24 can automatically dispense sheet material when the cover is closed and the dispenser is put into operation. The paper detection sensor 158 further can determine if a sheet is hanging from the dispenser. If sheet material is hanging, the control circuit will then monitor when the sheet of material is removed. For example, a cutting mechanism movement detector, which may arranged and configured to detect actuation or movement of the cutting mechanism 120; the pawl member 152; and/or the paper detection sensor 158 can determine the removal of paper and reset the dispenser. The next sheet will be dispensed automatically. If the paper detection sensor 158 determines the absence of hanging sheet material, the motor 60 will be activated to dispense the next sheet. The control circuit will then determine if the sheet has been removed before dispensing another sheet.

In one embodiment, the dispenser 10 is operative in a first mode to be responsive to a signal from the proximity sensor to dispense a sheet of material. The dispensing mechanism is operative in a second mode to dispense a next sheet in response to the signal means being activated by movement of the cutting mechanism or tear bar to its extended position in response to dispensed sheet material 12 being removed from the dispenser. In another embodiment, the dispenser 10 can be operative in a second mode to dispense a next sheet in response to a signal means being activated by movement of the cutting mechanism 120, and a signal from a paper detection sensor 158 that the sheet material 10 has been removed from the dispenser. Such a sensor can be affixed to an external surface of the discharge chute 22 rather than inside the discharge chute.

The dispenser 10 generally can dispense a measured length of the sheet material, which may be accomplished by various means, such as a timing circuit that stops the drive feed rollers after a predetermined time. In one embodiment, the drive motor of the drive or feed roll can provide direct feedback as to the number of revolutions of the feed roller, indicative of an amount of the sheet material fed thereby. Alternatively, a motor revolution counter can be provided that measures the degree of rotation of the drive rollers and is interfaced with control circuitry to stop a drive roller motor after a defined number of revolutions of the feed rollers. This counter may be an optical encoder type of device, or a mechanical device. The control circuitry may include a device to allow maintenance personnel to adjust the sheet length by increasing or decreasing the revolution counter set point. The multi-position switch 160 can also be in operable communication with the control circuit to select one of a plurality of time periods as a delay between delivery of a first sheet and delivery of a next sheet to the user.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed is:

1. A dispenser that dispenses a flexible, rolled sheet material, comprising:

a dispenser housing;

a supply of the sheet material supported within the housing for feeding the sheet material along a path of travel defined through the housing;

a feed roller rotatably mounted within the housing and arranged along the path of travel of the sheet material, the feed roller comprising a body that engages the sheet material to pull the sheet material from the supply so as to dispense a selected amount of the sheet material therefrom;

a drive mechanism substantially integrated within the body of the feed roller, the drive mechanism comprising a motor at least partially received within and located along an interior portion of the body of feed roller and a gear assembly that includes one or more gears coupled to the body of the feed roller and to the motor so as to operatively link the motor to the body of the feed roller for driving rotation of the feed roller about the motor to dispense the selected amount of the sheet material;

one or more pressing rollers positioned adjacent the feed roller and biased toward the body of the feed roller sufficient to engage the sheet material between the one or more pressing rollers and the feed roller;

a cutting mechanism arranged along the body of the feed roller, the cutting mechanism comprising a cutting blade that is operatively connected to the body of the feed roller and is actuated with rotation thereof to at least partially cut or perforate a selected portion of the sheet material as the sheet material is dispensed;

a motor housing attached to a portion of the dispenser housing and extending at least partially into the body of the feed roller, the motor housing including a chamber that at least partially receives the motor for mounting the motor within the body of the feed roller, wherein the motor housing includes at least one portion disposed along an exterior surface thereof that is engaged by the cutting mechanism upon rotation of the body of the feed roller to activate the cutting mechanism to selectively cut or perforate the selected portion of the sheet material as it is dispensed; and wherein the gear assembly is a clutch assembly configured to selectively couple the motor to the feed roller so as to drive rotation of the feed roller upon actuation of the motor, and uncouple the motor and the feed roller for manual rotation of the feed roller.

2. The dispenser according to claim 1, wherein the cutting blade is at least partially housed within a chamber defined in the interior portion of the body of the feed roller, and the cutting blade is moveable into and out from one or more openings defined along the body of the feed roller during rotation thereof.

3. The dispenser according to claim 2, further comprising at least one moveable support coupled to the cutting blade and moveable along a slot defined in an end of the body of the feed roller to guide the movement of the cutting blade into and out of the body of the feed roller.

4. The dispenser according to claim 3, further comprising a cam follower connected to the at least one moveable support and engaging and riding along a cam track defined along a wall of the dispenser housing as the feed roller is rotated to cause movement of the cutting blade into and out from the one or more openings in the body of the feed roller.

5. The dispenser according to claim 1, wherein the motor includes a driveshaft having a drive gear mounted thereto and is located within the body of the feed roller such that the driveshaft of the motor is substantially offset with respect to a longitudinal axis of the body of the feed roller, wherein the gear assembly comprises a ring-gear arrangement having a ring-gear coupled to an interior surface of the body of the feed roller, and wherein the drive gear engages the ring-gear for driving rotation of the feed roller upon operation of the motor.

6. An electronic dispenser that dispenses a flexible, rolled sheet material, comprising:

a dispenser housing within which a supply of the sheet material is received, and including a discharge chute arranged along the housing through which the sheet material is dispensed;

a feed roller assembly comprising a driven feed roller including a body configured to at least partially engage the sheet material to feed the sheet material toward the discharge chute, and a drive mechanism substantially integrated within the body of the feed roller, the drive mechanism including a motor that drives the feed roller to dispense a selected portion of the sheet material through the discharge chute, wherein the motor is received within an interior cavity of the body of the feed roller such that the body of the feed roller rotates about the motor, and the motor is operatively coupled to the body of the feed roller by a gear assembly, the gear assembly having one or more gears arranged within the body of the feed roller and engaged by the motor for driving rotation of the feed roller;

at least one pressing roller biased toward the body of the feed roller for engaging the sheet material therebetween;

a cutting mechanism that is at least partially incorporated with the body of the feed roller and that is extensible upon rotation of the feed roller to selectively cut or perforate the selected portion of the sheet material as it is dispensed;

a motor housing mounted to the dispenser housing, the motor housing extending at least partially along the interior cavity defined within the body of the feed roller and defining a chamber that at least partially receives the motor so as to mount the motor within the interior cavity of the body of the feed roller, and wherein the motor housing includes a feature disposed along an exterior surface of the motor housing and which is at least partially engaged by the cutting mechanism upon rotation of the body of the feed roller to activate the cutting mechanism to selectively cut or perforate the selected portion of the sheet material as it is dispensed; and wherein the gear assembly is a clutch assembly configured to selectively couple the motor to the feed roller for driving rotation of the feed roller upon actuation of the motor, and uncouple the motor and the feed roller for manual rotation of the feed roller.

7. The dispenser according to claim 6, wherein a cutting blade is housed within the interior cavity defined in the body of the feed roller, and is moveable in and out of one or more openings defined along the body of the feed roller during operation thereof.

8. The dispenser according to claim 7, further comprising at least one moveable support coupled to the cutting blade and moveable along a slot defined in an end of the body of the feed roller for guiding the movement of the cutting blade into and out from the one or more openings in the body of the feed roller.

9. The dispenser according to claim 8, further comprising a cam follower connected to the moveable support and engaging and riding along a cam track defined along a wall of the dispenser housing as the feed roller is rotated to cause movement of the cutting blade into and out in the body of the feed roller.

10. The dispenser according to claim 6, wherein the motor comprises a driveshaft having a drive gear mounted thereto and is located within the body of the feed roller such that the driveshaft of the motor is substantially offset with respect to a longitudinal axis of the body of the feed roller, wherein the gear assembly comprises a ring-gear arrangement having a ring-gear coupled to an interior surface of the body of the feed roller, and wherein the drive gear engages the ring-gear for driving rotation of the feed roller upon operation of the motor.

* * * * *